US012286856B2

(12) United States Patent
Affleck et al.

(10) Patent No.: US 12,286,856 B2
(45) Date of Patent: Apr. 29, 2025

(54) WIRELESSLY ACTIVATED WELL SYSTEM

(71) Applicants: E-Flow Control Ltd, Scotland (GB); SAUDI ARABIAN OIL COMPANY, Dhahran (SA)

(72) Inventors: Michael Affleck, Aberdeen (GB); Tom Dixon, Aberdeenshire (GB)

(73) Assignees: SAUDI ARABIAN OIL COMPANY, Dhahran (SA); E-FLOW CONTROL LTD, Aberdeen (GB)

( * ) Notice: Subject to any disclaimer, the term of this patent is extended or adjusted under 35 U.S.C. 154(b) by 61 days.

(21) Appl. No.: 18/167,753

(22) Filed: Feb. 10, 2023

(65) Prior Publication Data

US 2024/0271501 A1 Aug. 15, 2024

(51) Int. Cl.
*E21B 33/035* (2006.01)
*E21B 33/06* (2006.01)

(52) U.S. Cl.
CPC ..... *E21B 33/0355* (2013.01); *E21B 33/06* (2013.01)

(58) Field of Classification Search
CPC ..... E21B 33/0355
See application file for complete search history.

(56) References Cited

U.S. PATENT DOCUMENTS 7,690,433 B2 * 4/2010 Reynolds ..... E21B 33/0355 166/341
8,464,797 B2 * 6/2013 Singh ..... E21B 33/038 166/344
9,033,049 B2 * 5/2015 Kotrla ..... E21B 41/0007 166/368
9,828,824 B2 * 11/2017 McAuley ..... E21B 33/06
(Continued)

FOREIGN PATENT DOCUMENTS

CN 200989202 Y 12/2007
CN 203232293 U 10/2013
(Continued)

OTHER PUBLICATIONS

International Search Report and Written Opinion Issued in Corresponding PCT Application No. PCT/US2024/014577, Mailed on Jul. 3, 2024, 20 pages.
(Continued)

*Primary Examiner* — Matthew R Buck
(74) *Attorney, Agent, or Firm* — Osha Bergman Watanabe & Burton LLP

(57) ABSTRACT

A well system includes a local controller communicably coupled to a hydraulic diverter configured to control a well shut-in assembly at a well site operable to shut in a wellbore based on a command from the local controller or to shut in or open the wellbore based on a command from a control panel at or in a vicinity of the well site. The well system includes a remote controller located at a location remote from the local controller and the well site and configured to communicate a wireless signal to the local controller to initiate the command from the local controller. The well system includes the hydraulic diverter fluidly coupled to the well shut-in assembly. The hydraulic diverter is configured to, based on the command from the local controller, control the well shut-in assembly to shut in the wellbore and render the command from the control panel irrelevant.

20 Claims, 19 Drawing Sheets

(56) References Cited

U.S. PATENT DOCUMENTS

| | | | | |
|---|---|---|---|---|
| 10,605,034 | B2 * | 3/2020 | Affleck | E21B 33/06 |
| 10,787,877 | B2 * | 9/2020 | Pedersen | E21B 33/038 |
| 11,555,372 | B1 | 1/2023 | Al-Mousa | |
| 2012/0111572 | A1 * | 5/2012 | Cargol, Jr. | E21B 33/0355 166/363 |
| 2015/0094866 | A1 * | 4/2015 | Pereira | E21B 33/0355 700/282 |
| 2015/0096758 | A1 | 4/2015 | Babbitt | |
| 2016/0237804 | A1 | 8/2016 | Papadimitriou et al. | |
| 2018/0252065 | A1 | 9/2018 | Hemphill | |
| 2018/0274319 | A1 * | 9/2018 | Lycke | E21B 33/0355 |
| 2019/0025152 | A1 | 1/2019 | Hilpert et al. | |
| 2020/0284274 | A1 | 9/2020 | van Kuilenburg | |
| 2022/0056778 | A1 | 2/2022 | Olson et al. | |

FOREIGN PATENT DOCUMENTS

| | | | |
|---|---|---|---|
| CN | 104035383 | A | 9/2014 |
| CN | 108758345 | A | 11/2018 |
| CN | 111810076 | A | 10/2020 |
| CN | 213269833 | U | 5/2021 |
| CN | 214836242 | U | 11/2021 |
| WO | WO-8302798 | A1 * | 8/1983 |
| WO | 2016144943 | A1 | 9/2016 |
| WO | 2022064444 | A1 | 3/2022 |

OTHER PUBLICATIONS

M. Affleck and M. Gilleland, "Background to the Development of a Remote Controlled Drilling Blowout Preventer (BOP) Activation Technology for Surface BOP Applications," Society of Petroleum Engineers/IADC, SPE/IADC-178221-MS, Jan. 26, 2016, 14 pages.

* cited by examiner

WIRELESSLY ACTIVATED WELL SYSTEM

BACKGROUND

Embodiments disclosed herein relate to a wirelessly activated well system and, more particularly, to a wirelessly activated well system in an emergency condition.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a well system. The well system includes a local controller communicably coupled to a hydraulic diverter configured to control a well shut-in assembly at a well site, the well shut-in assembly being operable to shut in a wellbore based on a command from the local controller or to shut in or open the wellbore based on a command from a control panel at or in a vicinity of the well site. The well system further includes a remote controller located at a location remote from the local controller and the well site and configured to communicate a wireless signal to the local controller to initiate the command from the local controller. The well system further includes the hydraulic diverter fluidly coupled to the well shut-in assembly. The hydraulic diverter is configured to, based on the command from the local controller, control the well shut-in assembly to shut in the wellbore and render the command from the control panel irrelevant.

In another aspect, embodiments disclosed herein relate to a hydraulic diverter for a well shut-in assembly that comprises a blowout preventer (BOP) stack and a hydraulic power unit (HPU). The hydraulic diverter includes at least one solenoid valve and two hydraulically actuated valves piloted by the at least one solenoid valve. A preventer of the BOP stack is configured to be fluidly coupled to the HPU via the hydraulic diverter.

In yet another aspect, embodiments disclosed herein relate to a method for shutting a wellbore. The method includes communicating a wireless signal from a remote controller located at a location remote from a local controller and a well site to the local controller. The method further includes initiating a command from the local controller to a hydraulic diverter fluidly coupled to a well shut-in assembly based on the wireless signal from the remote controller. The method further includes controlling, by the hydraulic diverter, the well shut-in assembly to shut in the wellbore based on the command from the local controller.

Other aspects and advantages of the claimed subject matter will be apparent from the following description and the appended claims.

DETAILED DESCRIPTION

The present disclosure relates to a remotely-activated well shut-in system that is operable to remotely activate a well shut-in operation from a location remote from a rig when rig evacuation is occurring or has occurred. In one or more embodiments, the remotely-activated well shut-in system includes a local controller operable to activate a hydraulic power unit or via a hydraulic diverter in order to actuate a preventer to shut in the well. In one or more embodiments, the remotely-activated well shut-in system includes a remote controller operable to transmit a signal to the local controller to initiate the shut-in procedure. In some embodiments, the remote controller initiates the shut-in procedure through a wireless communication remote from the rig by tens to hundreds of yards, a mile, or more than several miles, to ensure safety of the rig personnel. In some embodiments, the remotely-activated well shut-in system may initiate the shut-in procedure of a land-based or shallow water well through line-of-sight (or substantial line-of-sight) wireless communication or wireless communications that are not required to be line of sight.

Figure 1:
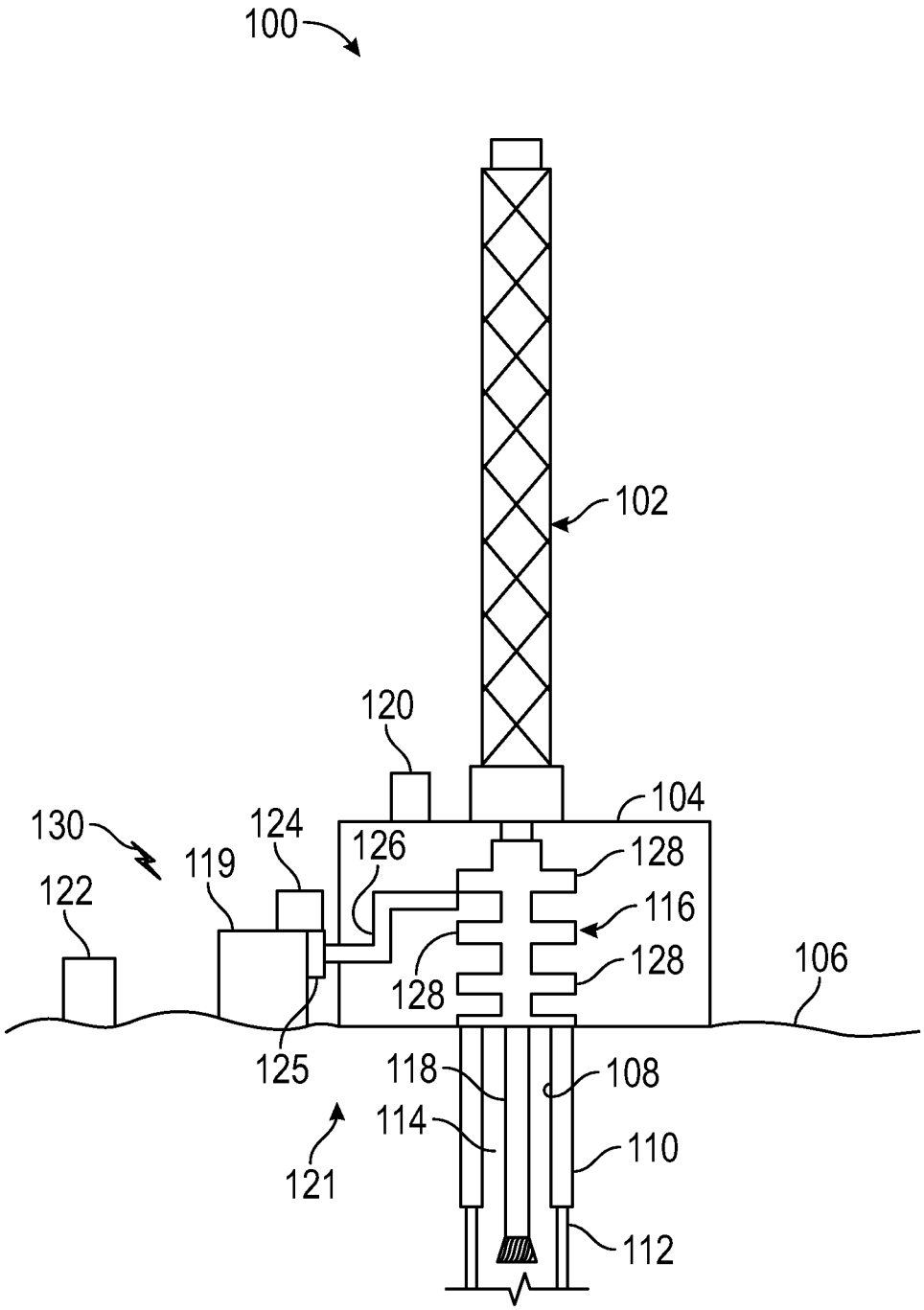
FIG. 1 is a schematic view of an example well system.

FIG. 1 illustrates a schematic view of an example rig and well system 100 that includes at least a portion of a remotely activated well shut-in system. As depicted, the well system 100 includes a workover or drilling rig 102 with a rig floor 104 that is positioned on or above the earth's surface 106 (for example, a terranean surface or a sub-sea surface) and extends over and around a wellbore 108 that penetrates a subterranean formation for the purpose of recovering hydrocarbons. The wellbore 108 may be drilled into the subterranean formation using any suitable drilling technique. The illustrated wellbore 108 extends substantially vertically (that is, vertical as designed) away from the earth's surface 106 over a vertical wellbore portion. In alternative operating environments, all or portions of the wellbore 108 may be vertical, deviated at any suitable angle, horizontal, or curved. The wellbore 108 may be a new wellbore, an existing wellbore, a straight wellbore, an extended reach wellbore, a sidetracked wellbore, a multi-lateral wellbore, and other types of wellbores for drilling and completing one or more production zones. Further, the wellbore 108 may be used for both producing wells and injection wells, and may be completely cased (with a conductor casing 110, surface casing 112, and other casings), partially cased (for example, with only the conductor casing 110 and surface casing 112), or open hole (for example, uncased) or variations thereof.

A wellbore tubular string 118 may be lowered into the subterranean formation for a variety of purposes (for example, drilling, intervening, injecting or producing fluids from the wellbore, workover or treatment procedures, or otherwise) throughout the life of the wellbore 108. In this illustrated example, the workover or drilling rig 102 may include a derrick with the rig floor 104 through which the wellbore tubular 118 extends downward from the drilling rig 102 into the wellbore 108. The workover or drilling rig 102 may include a motor driven winch and other associated equipment for extending the wellbore tubular 118 into the wellbore 108 to position the wellbore tubular 118 at a selected depth. While the operating environment depicted in FIG. 1 refers to a drilling rig 102 for conveying the wellbore tubular 118 within a land-based wellbore 108, in alternative implementations, workover rigs, wellbore servicing units (such as coiled tubing units), and the like may be used to lower the wellbore tubular 118 into the wellbore 108. The wellbore tubular 118 may alternatively be used in other operational environments, such as within an offshore wellbore operational environment where the wellbore 108 extends from the sea to a blowout preventer (BOP) stack 116 located within or just below the rig.

As illustrated, the tubular 118 extends through the BOP stack 116 that includes one or more (as shown, three) preventers 128. The illustrated BOP stack 116 may additionally include a set of two or more preventers used to ensure secondary pressure control of the wellbore 108. For example, the BOP stack 116 may include one or more ram-type preventers and, optionally, one or more annular-type preventers. Here, the preventers 128 may be ram type including blind, shear and pipe annular type, or otherwise. The particular configuration of the preventers of the BOP stack 116 may be optimized to provide maximum pressure integrity, safety, and flexibility in the event of a well control incident. The BOP stack 116 also includes various spools, adapters, valves, and piping outlets (not shown) to permit the circulation of wellbore fluids under pressure in the event of a well control incident.

Figure 4:
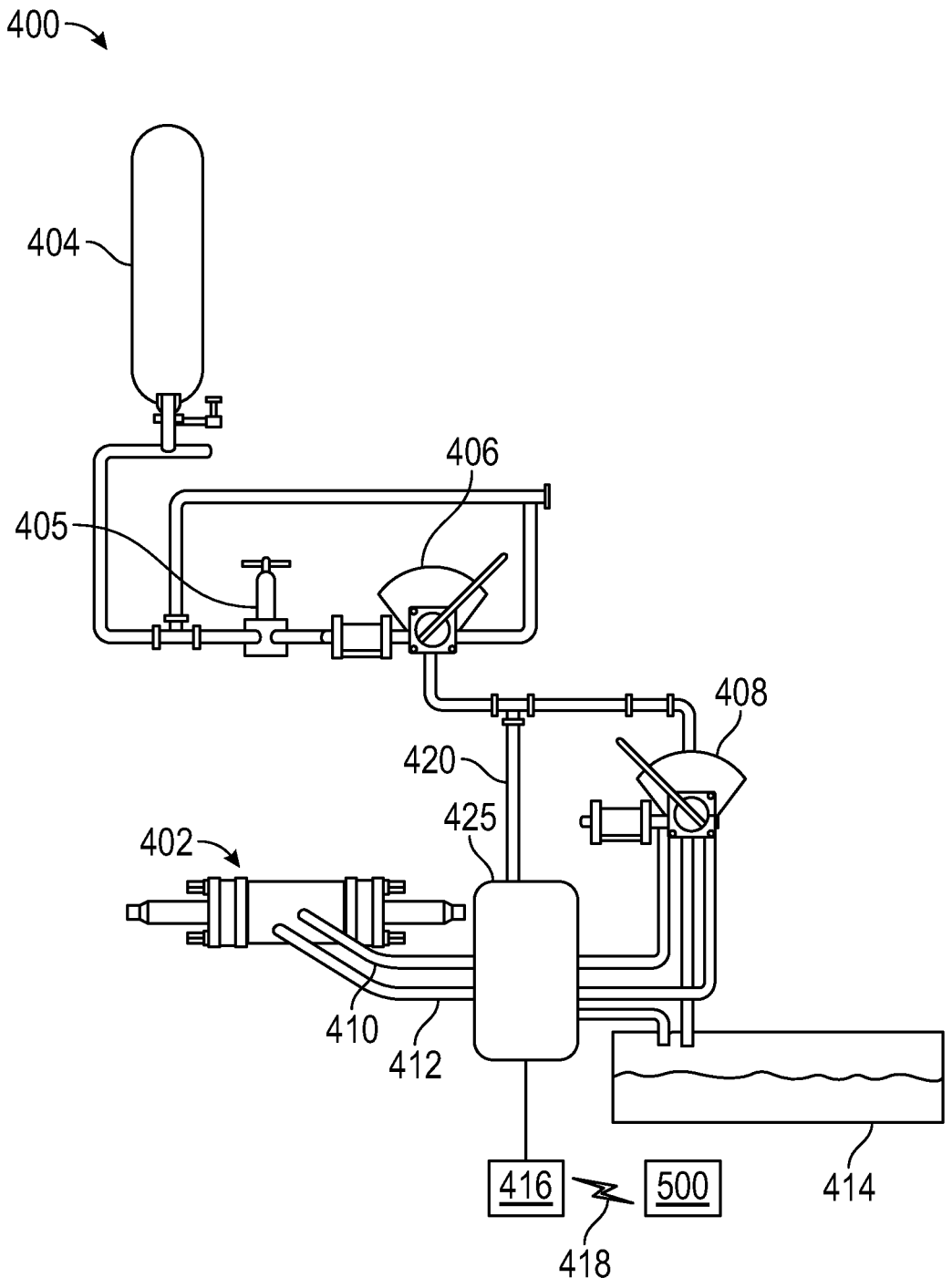
FIG. 4 is a schematic view of a hydraulic power unit coupled to a blowout preventer via a hydraulic diverter.

As illustrated, the preventers 128 of the BOP stack 116 are actuated by, for example, a hydraulic fluid that is circulated through control lines 126 from a hydraulic power unit (HPU) 119 via a hydraulic diverter 125 (both also shown in FIG. 4). The HPU 119, as described in more detail with reference to FIG. 4, is operable to circulate a controlled-pressure hydraulic fluid to one or more of the preventers 128 to actuate the one or more preventers 128 to shut in the wellbore 108. The BOP stack 116 and the HPU 119 together may be referred to as a well shut-in assembly 121. As illustrated, there may be two or more control panels for the HPU 119. One control panel 120 may be located on the rig floor 104 or in close proximity for easy operation by rig hands during workover, completion, drilling, or operations. Another control panel 122, for instance, may be located away from the rig floor 104 (for example, in tens or hundreds of yards), for example, by a drilling supervisor or tool pusher's office location. The control panel 122, for example, may be used to control the HPU 119 (for example, to actuate one or more of the preventers 128) when circumstances necessitate evacuation from the rig floor area 104. The control panel 120 and the control panel 122 may be operably coupled to the HPU 119, for example, through a hard-wire connection. In the event of a well control incident, rig personnel or a drilling supervisor may operate the control panel 120 or the control panel 122 to send a command through the hard-wire connection, for example, to the HPU 119 to circulate the hydraulic fluid to one or more preventers 128 to actuate the one or more preventers 128 to shut in the wellbore 108. When circumstances allow the shut wellbore 108 to reopen, for example, due to regaining control of the pressure of a formation fluid, the control panel 120 or the control panel 122 may be operated to send a command to the HPU 119 to actuate the one or more preventers 128 to open/reopen the wellbore 108.

In conventional well shut-in systems, a hydraulic fluid is circulated from a hydraulic power unit directly through control lines to a BOP stack to actuate the preventers. In one or more embodiments of the present disclosure, the hydraulic diverter 125 (as described in more detail below) is provided between the BOP stack 116 (the one or more preventers 128) and the HPU 119 and fluidly coupled to the BOP stack 116 and the HPU 119. The hydraulic fluid that is circulated from the HPU 119 to the preventers 128 to actuate the preventers 128 (to open or shut in) runs through the hydraulic diverter 125.

As shown in FIG. 1, a local controller 124 may be communicably coupled to the hydraulic diverter 125 and form at least a portion of a remotely-activated well shut-in system. The local controller 124 may operate to receive wireless commands 130 from a remote controller (not shown) and, based on such wireless commands, send one or more signals to the hydraulic diverter 125 to activate one or more preventers 128. In some embodiments, the remote controller may be a relatively large distance away from the local controller 124, for example, hundreds of yards, over a mile, between 1-5 miles, or over 5 miles (such as 10 miles), and still capable of communicating the wireless commands 130 to the local controller 124. In some embodiments, the wireless commands 130 may be one way communication from the remote controller to the local controller 124. In other embodiments, the wireless commands 130 may include two-way communication between the remote controller and the local controller 124.

In one or more embodiments, the wireless commands 130 may be radio frequency (RF) signals, cellular signals, Wi-Fi signals, satellite signals, or other form of airborne wireless communication. In some embodiments, the wireless commands 130 may be line-of-sight commands, for example, mostly or only operable to communicate data between the remote controller and the local controller 124 when such components are unimpeded (or substantially unimpeded) by physical obstacles. In some embodiments, the wireless commands 130 may operate to communicate data even when the remote controller and the local controller 124 are not in line-of-sight.

The hydraulic diverter 125 in a normal state, i.e., in the absence of the command from the local controller, allows the hydraulic fluid to flow through and actuate the preventers 128 of the BOP stack 116 in accordance with the command from the control panel 120 or the control panel 122. In contrast, as described in more detail below, when the hydraulic diverter 125 is activated by the command from the local controller, the hydraulic diverter 125 operates to activate one or more of the preventers 128 to shut in the wellbore 108 and renders the command from the control panels 120 and 122 irrelevant. That is, the activated preventers 128 remains closed whether the command from the control panels 120 and 122 is intended for opening or closing the wellbore 108, or otherwise.

Figure 2:
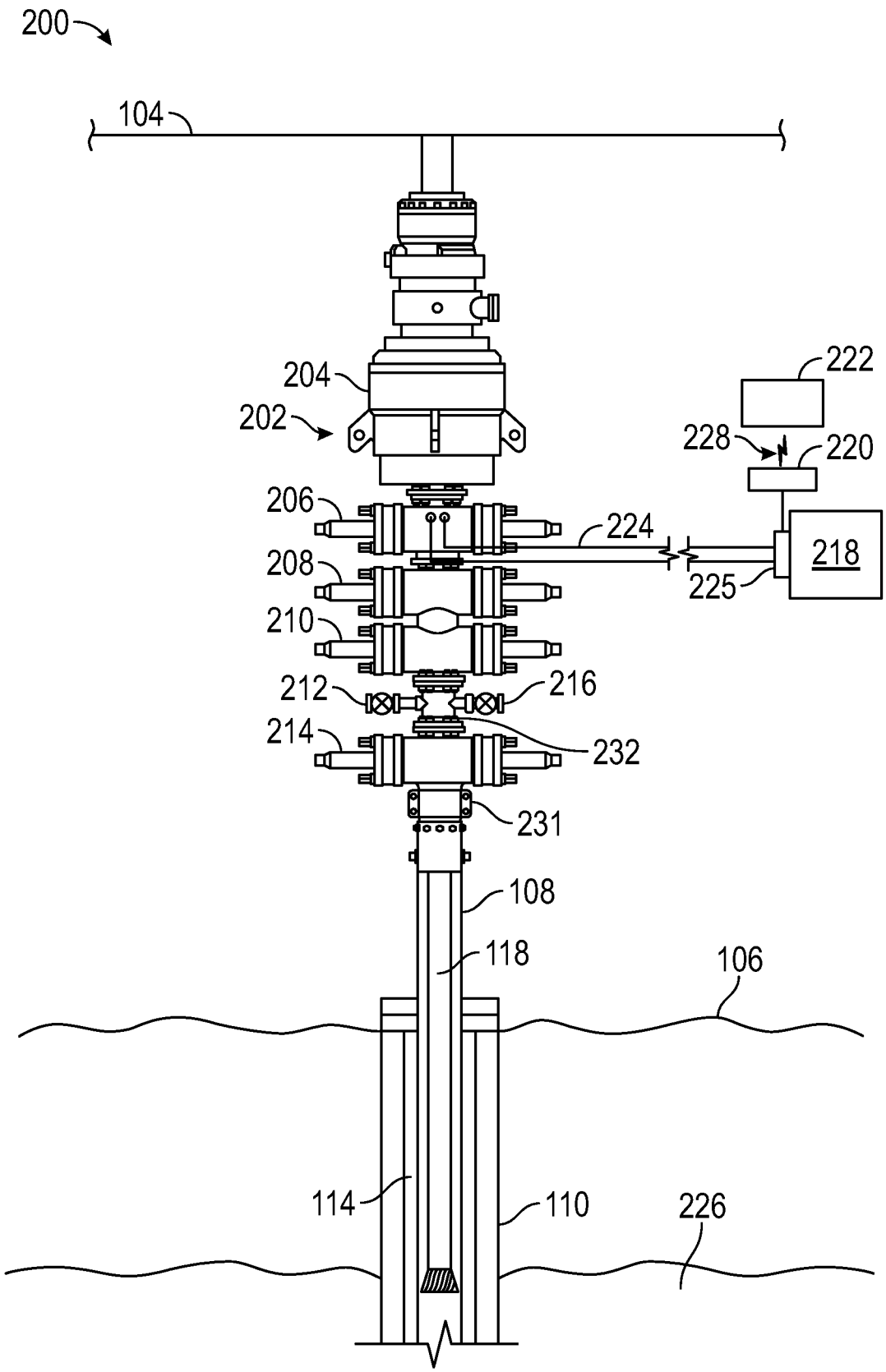
FIG. 2 is a schematic view of an example of a remotely-activated well shut-in system.

FIG. 2 illustrates a schematic view of an example of a remotely-activated well shut-in system 200. The remotely-activated well shut-in system 200 operates to facilitate communication from a remote controller 222 to a local controller 220 in order to operate a hydraulic diverter 225. The hydraulic diverter 225, in turn, draws a hydraulic fluid from an HPU 218 to actuate one or more preventers in a BOP stack 202 to shut in the wellbore 108. In some embodiments, the remote controller 222 may be located relatively far from the local controller 220 during communication to the local controller 220, for example, greater than a mile, between 1-5 miles, or over 5 miles. The HPU 218, the hydraulic diverter 225, and the local controller 220 may be located relatively close to the wellbore 108, for example, within tens or hundreds of yards. Thus, the remote controller 222 may be used to actuate one or more preventers of the BOP stack 202 when circumstances may require that well personnel leave a near vicinity of the wellbore 108 (for example, less than a mile) without shutting in the well or ensuring that the well is shut in.

As illustrated in this example, the remotely-activated well shut-in system 200 includes the BOP stack 202 coupled with the wellbore 108 that extends into the terranean surface 106. The BOP stack 202 includes an annular preventer 204, ram preventers 206, 208, 210, and 214, a kill line 212, a choke line 216, spool pieces 232, and cross overs 231. Each of the preventers 206, 208, 210, and 214 may be any type of preventer, for example, ram, shear, or pipe. In some embodiments, the preventer 214 may be a pipe-type preventer to seal around the tubing string 118 so that, upon well shut-in, the tubing string 118 is not lost in the wellbore 108. In some embodiments, the preventers 206, 208, and 210 may be shear preventers that shear the tubing string 118 and seal the wellbore 108 against loss of hydrocarbon fluid to the terranean surface 106. In any event, a well operator may choose the particular type of preventer for each of the preventers 204, 206, 208, 210, and 214.

As illustrated in this example, control lines 224 (for example, hydraulic lines) from the hydraulic diverter 225 are fluidly coupled to the preventer 206. In some embodiments, the preventer 206 may be a retro-fit preventer added for the purpose of providing additional remote shut-in functionality. In this case, the HPU 218 and the hydraulic diverter 225 are a unit dedicated to the preventer 206 and is additional to the conventional rig HPU and BOP system. The preventer 206 may be added to the BOP stack 202 after fabrication, after installation, or otherwise, specifically to implement the remotely-activated well shut-in system 200. In some embodiments, the remotely-activated well shut-in system 200 may be retrofitted to the BOP stack 202.

In some embodiments, the preventer 206 may be an original component of the BOP stack 202 (for example, included during fabrication). Further, although shown as connecting the hydraulic diverter 225 and the preventer 206, the hydraulic diverter 225 may be fluidly coupled to control any of the preventers in the BOP stack 202. Further, there may be multiple hydraulic diverters fluidly coupled to control the multiple preventers in the BOP stack 202, and the multiple hydraulic diverters may be fluidly coupled to one or more HPUs to draw hydraulic fluids. One or more of the multiple hydraulic diverters may include a separate local controller 220; alternatively, a single local controller 220 may communicate with multiple hydraulic diverters.

In the illustrated example, the local controller 220 is communicably coupled to the hydraulic diverter 225 (for example, hardwired or otherwise) and wirelessly coupled through wireless commands 228 to the remote controller 222. As noted above, the wireless commands 228 may be one-way communication (for example, from the remote controller 222 to the local controller 220) or may be two way communication between the controllers 220 and 222. As described in more detail below, the remote controller 222 may be activated to send a particular wireless command 228 to the local controller 220, which in turn would signal (for example, through control wires, hydraulic fluid lines, wireless commands, or otherwise) the hydraulic diverter 225 to draw the hydraulic fluid from the HPU 218 to operate the preventer 206 to shut in the wellbore 108.

Similar to the example shown in FIG. 1, the hydraulic diverter 225 in a normal state, i.e., in the absence of the command from the local controller 220, allows the hydraulic fluid to flow through and actuate the preventer 206 in accordance with the command from a control panel (not shown) at or in a vicinity of the well site. In contrast, as described in more detail below, when the hydraulic diverter 225 is activated by the command from the local controller 220, the hydraulic diverter 225 operates to activate the preventer 206 to shut in the wellbore 108 and renders the command from the control panel irrelevant. That is, the activated preventer 206 remains closed whether the command from the control panel is intended for opening or closing the wellbore 108, or otherwise.

Figure 3:
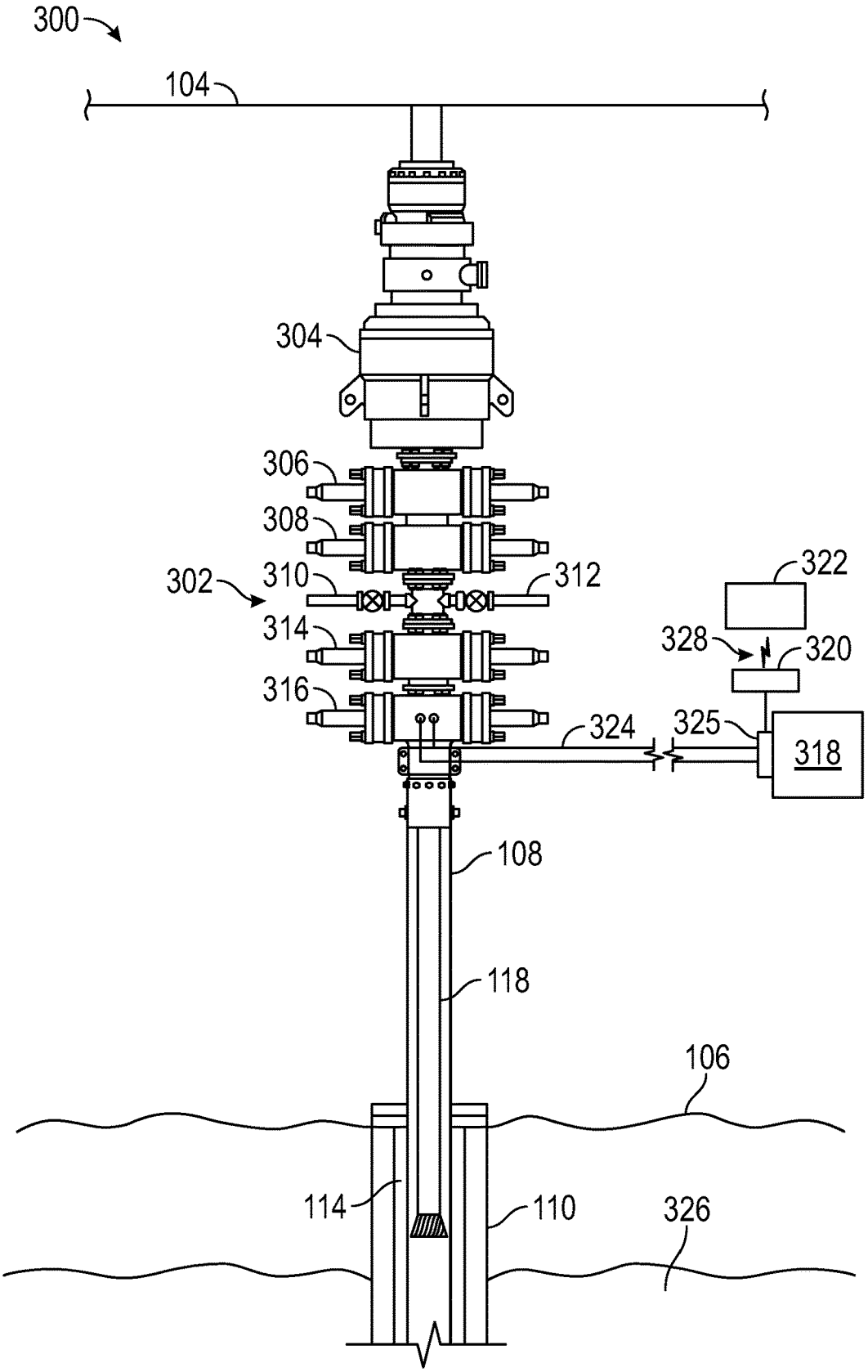
FIG. 3 is a schematic view of another example of a remotely-activated well shut-in system.

FIG. 3 illustrates a schematic view of another example of a remotely-activated well shut-in system 300. The remotely-activated well shut-in system 300 is similar to the remotely-activated well shut-in system 200, but an HPU 318 is hydraulically coupled, via a hydraulic diverter 325, to a BOP stack 302, below the inlets/outlets for a choke line 312 and a kill line 310. The remotely-activated well shut-in system 300 operates to facilitate communication from a remote controller 322 to a local controller 320 in order to operate the hydraulic diverter 325. The hydraulic diverter 325, in turn, is operated to actuate one or more preventers in the BOP stack 302 to shut in the wellbore 108. In some embodiments, the remote controller 322 may be located relatively far from the local controller 320 during communication to the local controller 320, for example, greater than a mile, between 1-5 miles, or over 5 miles. The HPU 318, the hydraulic diverter 325, and the local controller 320 may be located relatively close to the wellbore 108, for example, within tens or hundreds of yards. Thus, the remote controller 322 may be used to actuate one or more preventers of the BOP stack 302 when circumstances may require that well personnel leave a near vicinity of the wellbore 108 (for example, less than a mile) without shutting in the well or ensuring that the well is shut in.

As illustrated in this example, the remotely-activated well shut-in system 300 includes the BOP stack 302 coupled with the wellbore 108 that extends into the terranean surface 106. The BOP stack 302 includes an annular preventer 304, preventers 306, 308, 314, and 316, the kill line 310, and the choke line 312. Each of the preventers 306, 308, 314, and 316 may be any type of preventer, for example, blind, shear, or pipe. In some embodiments, the preventer 316 may be a pipe-type preventer to seal around the tubing string 118 so that, upon well shut-in, the tubing string 118 is not lost in the wellbore 108. In some embodiments, the preventers 306, 308, and 314 may be ram or shear preventers that shear the tubing string 118 and seal the wellbore 108 against loss of hydrocarbon fluid to the terranean surface 106. In any event, a well operator may choose the particular type of preventer for each of the preventers 304, 306, 308, 314, and 316.

As shown in FIG. 3, the BOP stack 302 includes the kill line 310. The kill line 310 may be fluidly coupled to a pump (not shown). The BOP stack 302 also includes the choke line 312. The choke line 312 may also be fluidly coupled to a backpressure choke/manifold on the rig floor or elsewhere.

As illustrated, control lines 324 (for example, hydraulic, electrical, or wireless communication lines) from the hydraulic diverter 325 are coupled to the preventer 316. In some embodiments, the preventer 316 may be a retro-fit preventer. The preventer 316 may be added to the BOP stack 302 after fabrication, after installation, or otherwise, specifically to implement the remotely-activated well shut-in system 300. In some embodiments, the remotely-activated well shut-in system 300 may be retrofitted to the BOP stack 306. In some embodiments, the preventer 316 may be an original component of the BOP stack 306 (for example, included during fabrication).

Further, although shown as connecting the hydraulic diverter 325 and the preventer 306, the hydraulic diverter 325 may be fluidly or electrically coupled to control any of the preventers in the BOP stack 302. Further, there may be multiple hydraulic diverters (for example, one hydraulic diverter for one preventer) fluidly or electrically coupled to control the multiple preventers in the BOP stack 302. One or more of the multiple hydraulic diverters may include a separate local controller 320; alternatively, a single local controller 320 may communicate with multiple hydraulic diverters.

In the illustrated example, the local controller 320 is communicably coupled to the hydraulic diverter 325 (for example, hardwired or otherwise) and wirelessly coupled through wireless commands 328 to the remote controller 322. As noted above, the wireless commands 328 may be one-way communication (for example, from the remote controller 322 to the local controller 320) or may be two way communication between the controllers 320 and 322. As described in more detail below, the remote controller 322 may be activated to send a particular wireless command 328 to the local controller 320, which in turn would signal (for example, through control wires, hydraulic fluid lines, wireless commands, or otherwise) the hydraulic diverter 325 to draw the hydraulic fluid from the HPU 318 to operate the preventer 316 to shut in the wellbore 108.

Similar to the examples shown in FIGS. 1 and 2, the hydraulic diverter 325 in a normal state, i.e., in the absence of the command from the local controller 320, allows the hydraulic fluid to flow through and actuate the preventer 316 in accordance with the command from a control panel (not shown) at or in a vicinity of the well site. In contrast, as described in more detail below, when the hydraulic diverter 325 is activated by the command from the local controller 320, the hydraulic diverter 325 operates to activate the preventer 316 to shut in the wellbore 108 and renders the command from the control panel irrelevant. That is, the activated preventer 316 remains closed whether the command from the control panel is intended for opening or closing the wellbore 108, or otherwise.

FIG. 4 illustrates a schematic view of an HPU 400 coupled to a blowout preventer 402 via a hydraulic diverter 425. The hydraulic diverter 425 can be activated with a local controller 416 of a remotely-activated well shut-in system. The HPU 400 circulates a hydraulic fluid to the preventer 402 in order to actuate the preventer 402. Although this example HPU 400 operates the preventer 402 hydraulically (for example, to actuate the rams or shears in the preventer 402), other forms of HPUs may include electrical power HPUs, thermal reaction based or explosives based HPUs, and otherwise. The HPU 400 may be specified to operate under a hydrocarbon release condition at a wellbore.

In this example, the HPU 400 includes, among other components, an accumulator supply tank 404 that stores pressurized hydraulic fluid, a pressure regulator unit 405 that enables fluid pressure reduction or regulation, a regulator or bypass valve 406, a control valve 408, a "close" supply control line 410 that fluidly couples the control valve 408 to the preventer 402 via the hydraulic diverter 425, a "open" control line 412 that also fluidly couples the control valve 408 to the preventer 402 via the hydraulic diverter 425, and a hydraulic fluid reservoir 414.

In one or more embodiments, the HPU 400 operates as follows to activate the preventer 402. The hydraulic fluid is pumped (with a pump, not shown) from the fluid reservoir 414 to the supply tank 404 and stored under pressure. The usual storage pressure is, for example, 3,000 or 5,000 psi. In general, the stored hydraulic fluid in the tank 404 is at a high enough pressure to activate the preventer 402 and is designed to be used as a primary and backup system, for example, when electrical power or rig air supply has failed (thus rendering a pump or pumps inoperative). When the fluid in the tank 404 is needed, regulator valve 406 allows fluid to flow at the required pressure from the tank 404. The control valve 408 (for example, a four-way control valve) is then adjusted to allow fluid flow from the regulator valve 406 via the hydraulic diverter 425 to the close or open hydraulic lines 410 or 412 (depending on functional requirements) and to the preventer 402. Here, the hydraulic diverter 425 is in a normal state, i.e., in the absence of a command from the local controller 416, and thus allows the hydraulic fluid to flow through and actuate the preventer 402 in accordance with a command from a control panel (not shown) at or in a vicinity of a well site. In contrast, as described in more detail below, when the hydraulic diverter 425 is activated by the command from the local controller 416, the hydraulic diverter 425 operates to activate the preventer 402 by pressurizing the close line 410 and renders the command from the control panel irrelevant. That is, the activated preventer 402 remains closed whether the command from the control panel is intended for opening or closing the preventer 402, or otherwise.

In this example, the local controller 416 is operably coupled to the hydraulic diverter 425. Thus, for example, a command to activate the preventer 402 may be sent from the local controller 416 to the hydraulic diverter 425 to draw hydraulic fluid (for example, from the tank 404 through the regulator valve 406) to activate the preventer 402. In this case, the hydraulic fluid is circulated through a hydraulic line 420 that bypasses the control valve 408. A ball valve (not shown), for example, may be disposed in the hydraulic line 420 to isolate the hydraulic line 420 if not in use. As illustrated, a remote controller 500 (shown in more detail in FIG. 5) communicates wireless commands 418 to the local controller 416, for example, to activate the local controller 416 to actuate the preventer 402. In some embodiments, the local controller 416 may wirelessly communicate data, such as a confirmation that the preventer 402 has been actuated, to the remote controller 500.

In some embodiments, the control panel may be operably coupled to the control valve 408 (for example, to a valve actuator or motor of the valve 408) or the regulator bypass valve 406, or both. Thus, for example, a command to activate the preventer 402 may be sent from the control panel to an actuator of the control valve 408 to adjust the valve 408 to allow hydraulic fluid to flow (for example, from the tank 404 through the regulator valve 406) via the hydraulic diverter 425 (in a normal state) to the preventer 402.

In some embodiments, the control panel may be operably coupled to the regulator bypass valve 406 (for example, to a valve actuator or motor of the valve 406). Thus, for example, a command to activate the preventer 402 may be sent from the control panel to an actuator of the valve 406 to adjust the valve 406 to allow hydraulic fluid to flow. The bypass valve 406 is thus controlled to allow unregulated pressured fluid to "bypass," for example, from the tank 404 through the regulator valve 406, which is set to bypass regulated pressure and apply full system pressure, from tank 404. The bypassed fluid is circulated to the close line 410 via the hydraulic diverter 425.

Figure 5:
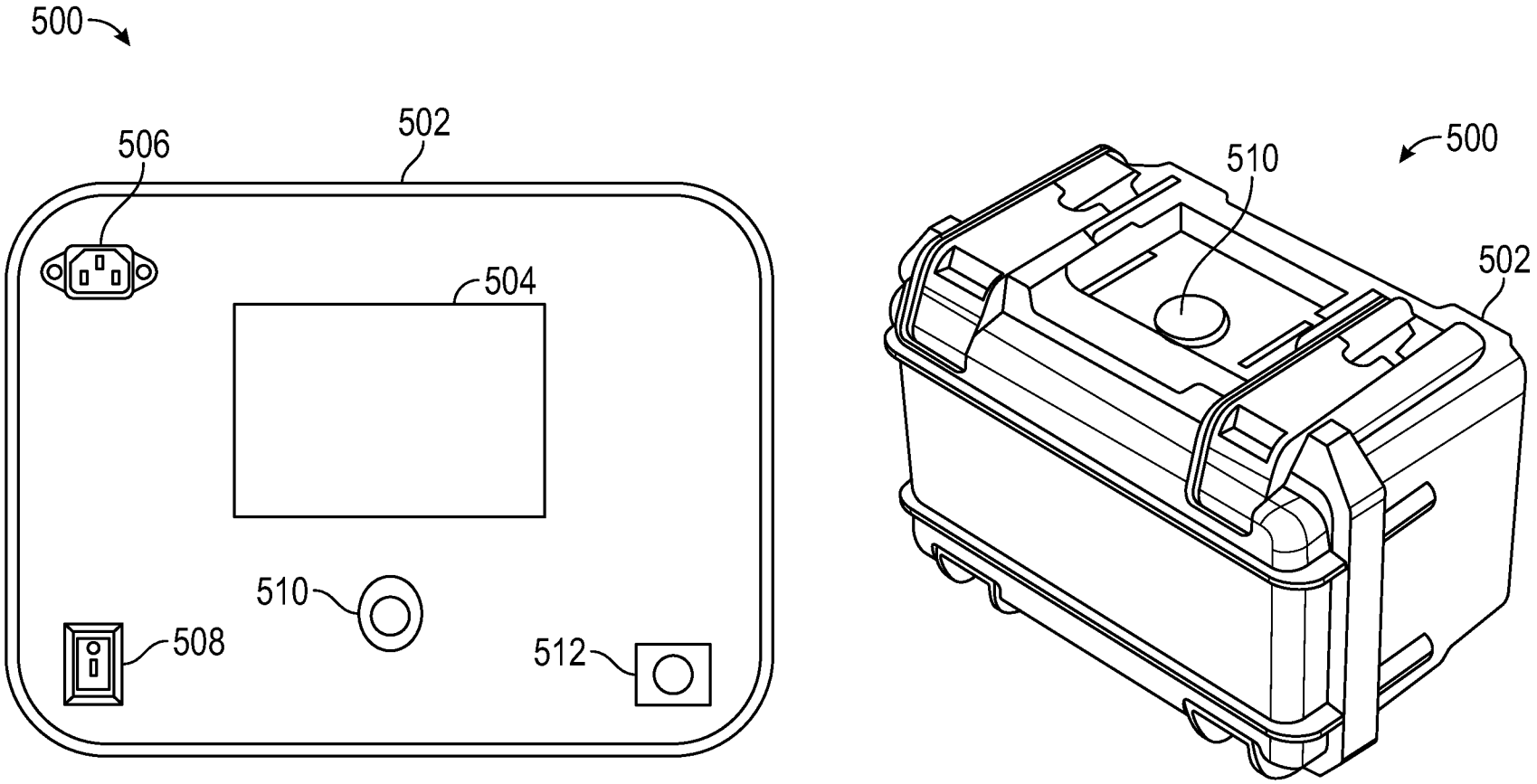
FIG. 5 is a schematic view of an example of a remote controller.

FIG. 5 illustrates an example of a remote controller 500 of a remotely-activated well shut-in system. As illustrated, the remote controller 500 includes a case 502 (for example, a ruggedized case) that includes an activation switch 510 that is exposed through the case 502. In some embodiments, the activation switch 510 may only be exposed by opening the case 502. The activation switch 510 may not be a single point control of activation of a preventer on a BOP stack (such as the preventers/BOP stacks described above). For example, by pressing the activation switch 510, simultaneously with another key activated switch, button, code entry into screen 504 or other interlock type system or method designed to prevent accidental function activation, a wireless signal may be sent to a local controller communicably coupled to a hydraulic diverter. The signal commands the local controller to activate the hydraulic diverter, which in turn, draws a hydraulic fluid from an HPU to a particular preventer of a BOP stack to shut in a well.

In some embodiments, the activation switch 510 may include or be electrically coupled to a wireless transmitter or wireless transceiver of the remote controller 500. The wireless transmitter or wireless transceiver may facilitate one or more wireless protocols, such as Wi-Fi, cellular, RF, satellite, or otherwise. Wireless transmissions may be secure and protected with a suitable "handshake" between the remote controller 500 and the local controller to prevent accidental activation by third party systems including WiFi, RF, Satellite, cellular, or otherwise. The wireless transmitter or wireless transceiver may use line-of-sight transmission, for example, only operable to communicate data between the remote controller and local controller when such components are unimpeded (or substantially unimpeded) by physical obstacles. The wireless transmitter or wireless transceiver may be operated to communicate data even when the remote controller and local controller are not in line-of-sight.

The remote controller 500 also includes a display 504 to display information, such as information received from a local controller through wireless communication, or other information (for example, diagnostic, testing, or otherwise). In some embodiments, the display 504 may confirm that a "close" command has been sent to the local controller to activate the hydraulic diverter to "close" a preventer in a BOP stack by drawing a hydraulic fluid from a hydraulic power unit. In some embodiments, the remote controller 500 and the display 504 facilitate and display a health check of the remote controller 500, a health check of the communication link with the local controller, a confirmation of function "close" and feedback on volumes pumped versus expected volumes or other such methods to increase confidence that the BOP stack has shut in the well.

Further, in some embodiments, the remote controller 500 or the local controller may include an automated functionality to automatically send the "close" signal in the event of, for example, excess heat detection (explosion), gas detection, or other operationally or procedurally triggering response. Additional channels of data collected from instrumentation around the local wireless controller can be transmitted to the remote controller 500 for display on the display 504 to facilitate a more informed decision at a safe distance from the rig site.

In the illustrated example of remote controller 500, a power input 506 is provided to allow for electrical power to be provided to the remote controller 500. In some embodiments, the power input 506 may recharge an independent power source (for example, batteries, capacitor, or otherwise) that can power the remote controller 500 decoupled from a wired power source. In the illustrated example, the remote controller 500 also includes an on-off button 508 and a safety lock 512. The on-off button 508 may allow an operator of the remote controller 500 to turn the controller on or off, for example, to save the stored power of the remote controller 500. The safety lock 512 may be provided to prevent accidental system function, for example, accidental transmission of a "close" signal to a local controller. The safety lock 512 may be a switch, button, code entry into screen 504 or other interlock type system or method designed to prevent accidental function activation.

In some embodiments, the remote controller 500 (as well as a local controller such as 124, 220, 320, or 416) may be or include a system of one or more processors that can be configured to perform particular actions by virtue of having software, firmware, hardware, or a combination thereof installed on the remote controller 500 (or local controller) that in operation causes or cause the system to perform the actions. One or more computer programs, stored in a memory, can be configured to perform particular actions by virtue of including instructions that, when executed by the processors, cause the remote controller 500 (or local controller) to perform the actions.

Figure 6:
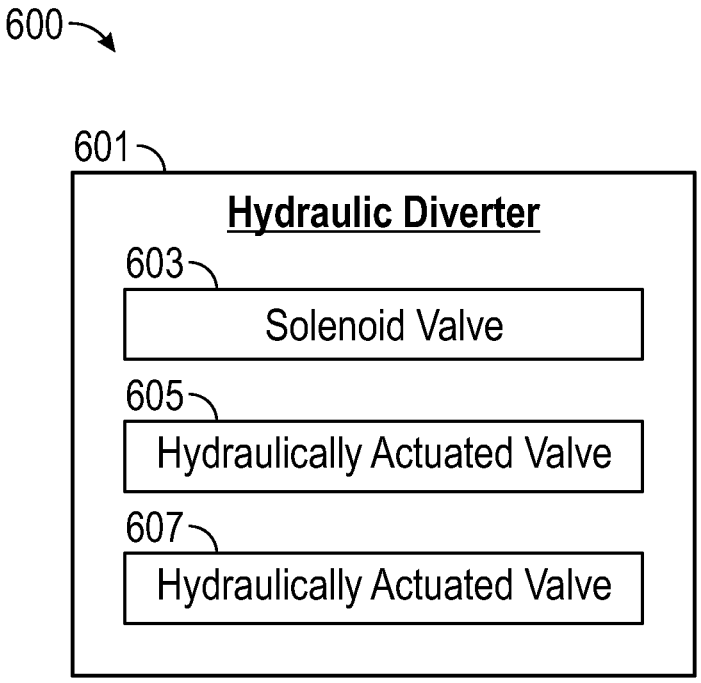
FIG. 6 is a block diagram of an example of a hydraulic diverter.

FIG. 6 is a block diagram of an example of a hydraulic diverter 600. As illustrated, the hydraulic diverter 600 includes a manifold housing 601. The hydraulic diverter 600 further includes a solenoid valve 603 and two hydraulically actuated valves 605 and 607 disposed in the manifold housing 601. The manifold housing 601 may include various inlets and outlets (not shown) fluidly coupled to hydraulic lines that lead to, for example, a control valve of an HPU, a pressurized hydraulic fluid source of the HPU, a hydraulic fluid reservoir of the HPU, and a preventer of a BOP stack. The solenoid valve 603 is configured to hydraulically pilot the two hydraulically actuated valves 605 and 607. Although shown as including one solenoid valve 603, the hydraulic diverter 600 may include two or more solenoid valves. In the case of two solenoid valves, for example, the two solenoid valves may be configured to hydraulically pilot the two hydraulically actuated valves 605 and 607, respectively.

In one or more embodiments, the hydraulic diverter 600 may include a transmitter/receiver (not shown) communicably coupled to a local controller through hardwire connection or wireless connection. As described in more detail below, upon receiving a command from the local controller by the transmitter/receiver, the solenoid valve 603 is activated to draw a hydraulic fluid from an HPU to hydraulically pilot the two hydraulically actuated valves 605 and 607. The two hydraulically actuated valves 605 and 607, in turn, operate to actuate a preventer of a BOP stack to shut in a wellbore. As described in more detail below, without activating the solenoid valve 603 (in the absence of the command from the local controller), the hydraulic diverter 600 is also configured to allow the hydraulic fluid from the HPU (through a control valve of the HPU) to pass through, for example, the hydraulically actuated valves 605 and 607, to shut in or open/reopen the wellbore based on a command from a control panel at or near the rig site that operates the control valve of the HPU.

In one or more embodiments, the solenoid valve 603 includes at least two positions (states): an activated position when the hydraulic diverter 600 receives the command from the local controller and a standby position in the absence of the command from the local controller. Each of the hydraulically actuated valves 605 and 607 also includes at least two positions (states): an activated position piloted by the activated hydraulic diverter 600 and a standby position piloted by the standby hydraulic diverter 600. The valves 603, 605, and 607 may be switched between the respective two positions by, for example, a movable component of the valve moving between two positions. In some embodiments, each of the valves 603, 605, and 607 may include position(s) in addition to those described above. Corresponding to the valves 603, 605, and 607 being in the activated or standby positions, the hydraulic diverter 600 is set to be in an activated or standby state. In the activated state, the hydraulic diverter 600 operates to actuate the preventer of the BOP stack to shut in the wellbore regardless of the state of the control valve of the HPU, that is, regardless of the command from the control panel at or near the rig site intended to operate the control valve of the HPU to open or shut in the wellbore, or otherwise. In the standby state, the hydraulic diverter 600 (specifically, the hydraulically actuated valves 605 and 607) allows the hydraulic fluid from the control valve of the HPU to flow through to actuate the preventer or otherwise. That is, in the standby state, the hydraulic diverter 600 yields control of the preventer of the BOP stack to the control valve of the HPU.

In one or more embodiments, the hydraulic diverter 600 may also include instrumentation (not shown) to monitor, for example, pressures in different hydraulic lines, states of the valves, etc. In some embodiments, the hydraulic diverter 600 may be electrically powered by the local controller placed nearby. In some embodiments, the hydraulic diverter 600 may be coupled to a separate power source or include an internal power source.

FIGS. 7-12 illustrate schematic diagrams showing fluid connections of different valve states. In these Figures, fluid connections of a hydraulic diverter 702 to a HPU (not shown), a control valve 724 of the HPU, and control lines of a preventer of a BOP stack are shown. As illustrated, the hydraulic diverter 702 includes a solenoid valve 704 and two hydraulically actuated valves 706 and 708. The solenoid valve 704 is fluidly coupled to the two hydraulically actuated valves 706 and 708 in order to pilot the two hydraulically actuated valves 706 and 708. For example, in the activated position of the solenoid valve 704, a port of the solenoid valve 704 may be fluidly coupled to a control port of each of the hydraulically actuated valves 706 and 708 to direct a pressurized hydraulic fluid to the control port of each of the hydraulically actuated valves 706 and 708, thereby rendering the hydraulically actuated valves 706 and 708 in their activated positions. For example, in the standby position of the solenoid valve 704, a port of the solenoid valve 704 may be fluidly coupled to a control port of each of the hydraulically actuated valves 706 and 708 to direct a pressurized hydraulic fluid to the control port of each of the hydraulically actuated valves 706 and 708, thereby rendering the hydraulically actuated valves 706 and 708 in their standby positions.

As illustrated in FIGS. 7-12, the hydraulic diverter 702 is fluidly coupled to the control valve 724 of the HPU. Specifically, the hydraulically actuated valve 708 is fluidly coupled via a close line 722 to the control valve 724. The close line 722 is a hydraulic line configured to be pressurized through the control valve 724 when a "close" command from a control panel at or in a vicinity of the well site is sent to the HPU to operate the control valve 724. Further, the hydraulically actuated valve 706 is fluidly coupled via an open line 720 to the control valve 724. The open line 720 is a hydraulic line configured to be pressurized through the control valve 724 when an "open" command from the control panel is sent to the HPU to operate the control valve 724. The control valve 724 is fluidly coupled via a hydraulic line 726 to a pressurized hydraulic fluid source of the HPU (not shown) and fluidly coupled via a hydraulic line 728 to a hydraulic fluid reservoir of the HPU (not shown).

The control valve 724 may include at least two positions (states) that correspond to pressurizing the close line 722 while venting the open line 720 and pressurizing the open line 720 while venting the close line 722, respectively. The control valve 724 may be set to either of the two positions based on the "close" command or "open" command from the control panel described above. In the illustrated examples, the control valve 724 includes an additional position that blocks the open line 720 and the close line 722 from the hydraulic lines 726 and 728. The control valve 724 may be set to this position by default or based on a "block" command from the control panel.

The hydraulic diverter 702 may be fluidly coupled to the pressurized hydraulic fluid source of the HPU. In the illustrated examples, the solenoid valve 704 is fluidly coupled via a pressure line 710 to the pressurized hydraulic fluid source of the HPU. The pressure line 710 provides a pressurized hydraulic fluid that may be utilized by the solenoid valve 704 to pilot the hydraulically actuated valves 706 and 708. Further, the hydraulically actuated valve 708 is fluidly coupled via a pressure line 718 to the pressurized hydraulic fluid source of the HPU. The pressure line 718 provides a pressurized hydraulic fluid that may be utilized by the hydraulically actuated valve 708 to actuate a preventer of a BOP stack to shut in a wellbore.

The hydraulic diverter 702 may also be fluidly coupled to the hydraulic fluid reservoir of the HPU. In the illustrated examples, the hydraulically actuated valves 706 and 708 are fluidly coupled via a return line 711 to the hydraulic fluid reservoir of the HPU. Further, the solenoid valve 704 is fluidly coupled via a return line 712 to the hydraulic fluid reservoir of the HPU. Such return lines as 711 and 712 are provided for venting hydraulic fluid, for example, from a valve or a preventer, as may be readily understood by one of ordinary skill in the art.

The hydraulic diverter 702 may also be fluidly coupled to a preventer of a BOP stack. In the illustrated examples, the two hydraulically actuated valves 706 and 708 of the hydraulic diverter 702 are fluidly coupled to the preventer (not shown). In particular, the hydraulically actuated valve 708 is fluidly coupled via a close line 716 to a close port (not shown) of the preventer, and the hydraulically actuated valve 706 is fluidly coupled via an open line 714 to an open port (not shown) of the preventer. The close line 716 and the open line 714 correspond to the close supply control line 410 and the open supply control line 412 shown in FIG. 4, respectively. The close line 716 and the open line 714 together correspond to the control lines 126, 224, and 324 shown in FIGS. 1-3. Whenever the close line 716 is pressurized by a pressurized hydraulic fluid and the open line 714 is vented, the preventer fluidly coupled to the hydraulic diverter 702 is actuated to close the wellbore. Whenever the open line 714 is pressurized by the pressurized hydraulic fluid and the close line 716 is vented, the preventer fluidly coupled to the hydraulic diverter 702 is actuated to open/reopen the wellbore. As described in more detail below, which of the close line 716 and the open line 714 is pressurized or vented may be based on a command from a local controller of a remotely-activated well shut-in system as described above or based on a command from a control panel at or in a vicinity of the well site.

FIGS. 7-12 illustrate different states of the valves 704, 706, 708, and 724 and the various fluid lines. In these Figures, pressurized lines are represented by solid lines, bleed or return lines are represented by dashed lines, and blocked or no-flow lines are represented by dotted lines.

Figure 7:
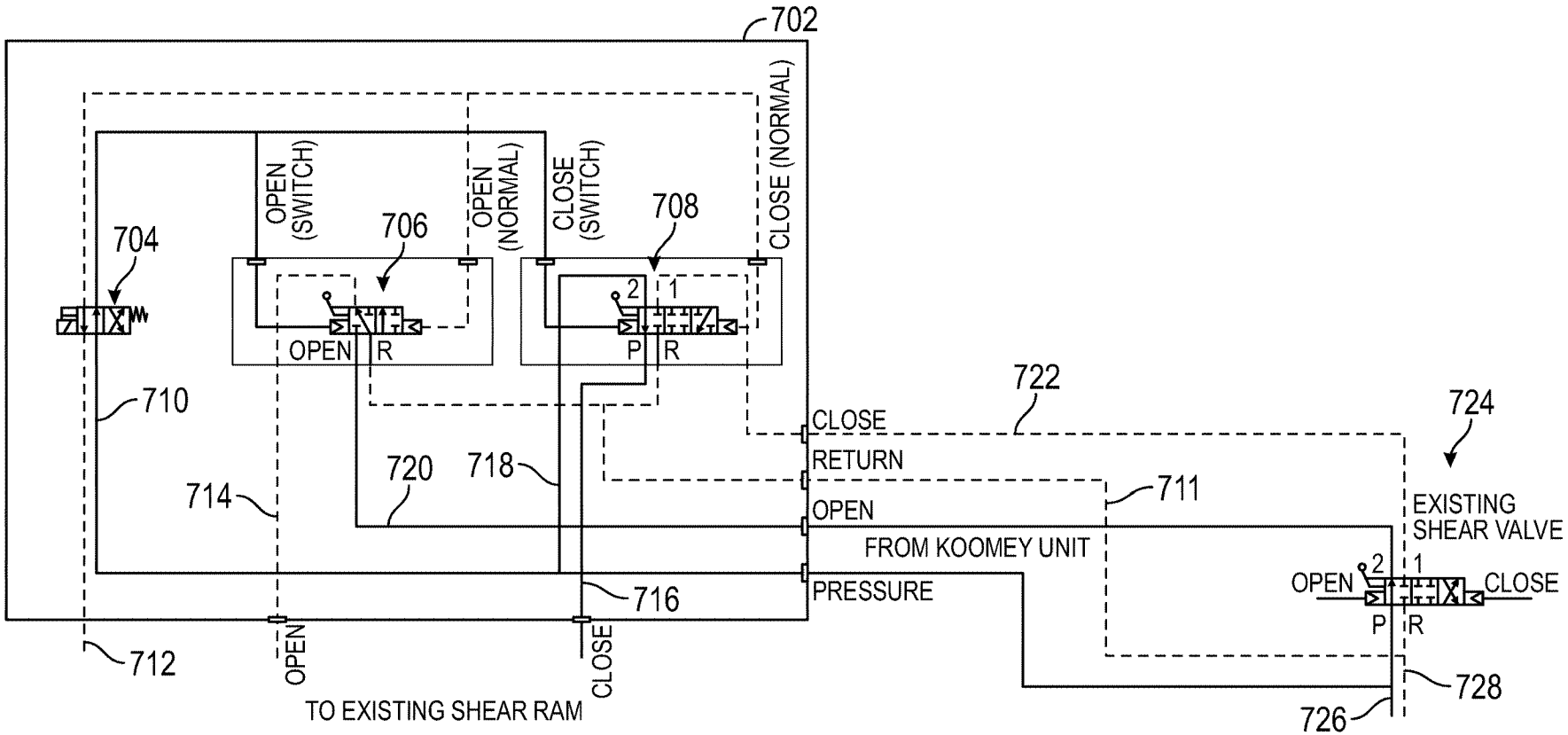
FIGS. 7-12 are schematic diagrams showing fluid connections of different valve states.
Figure 8:
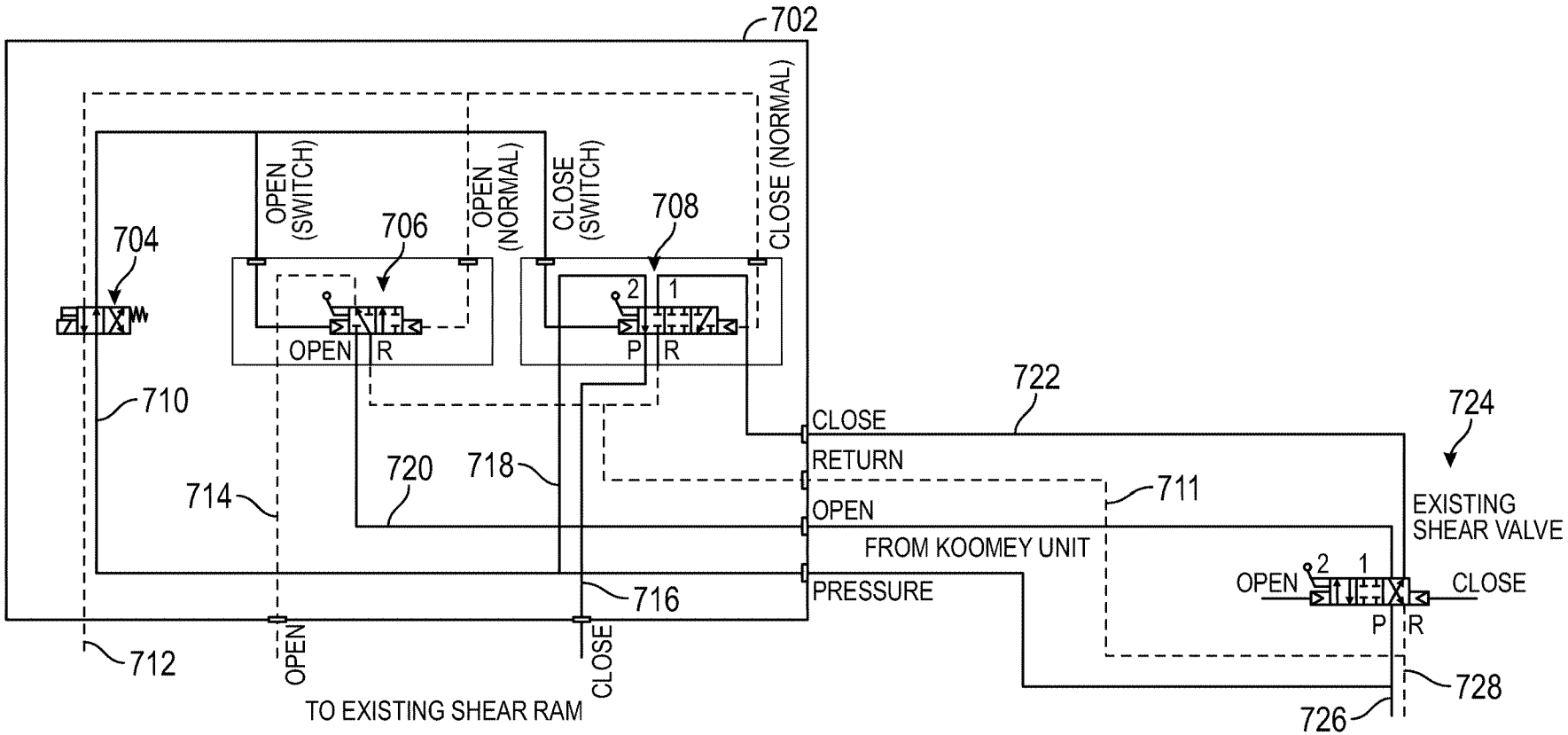
Figure 9:
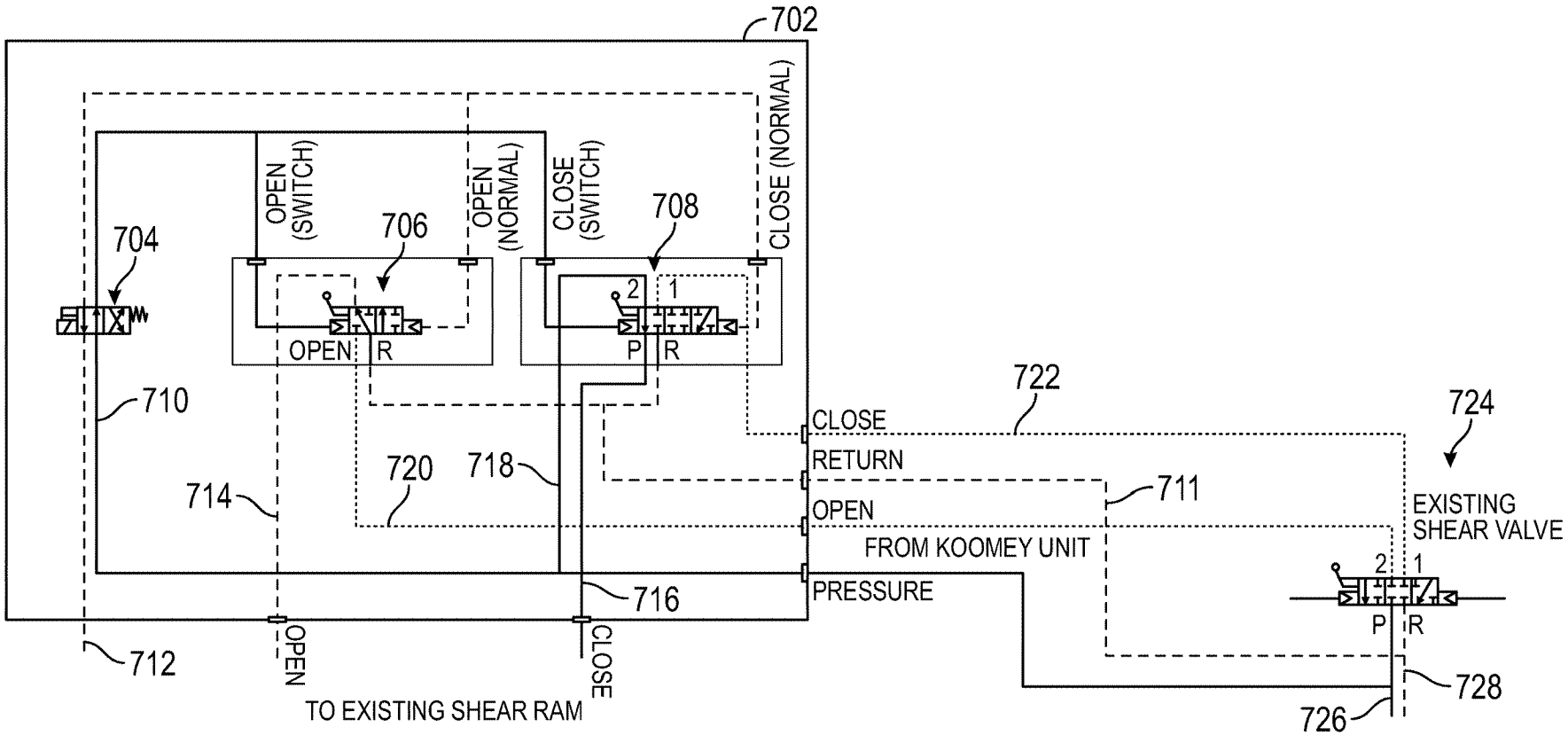

In the examples illustrated in FIGS. 7-9, the hydraulic diverter 702 is in an activated state due to, for example, receiving a command from a local controller, which, in turn, is initiated by a wireless signal sent from a remote controller to the local controller. In the activated state of the hydraulic diverter 702, the solenoid valve 704 is in the activated position thereof based on the command form the local controller. The solenoid valve 704, utilizing the pressurized hydraulic fluid from the pressurized hydraulic fluid source of the HPU via the pressure line 710, pilots the two hydraulically actuated valves 706 and 708 to be in the activated positions thereof. In activated position, the hydraulically actuated valve 706 vents, via the return line 711, the open line 714 that is fluidly coupled to the open port of the preventer. In activated position, the hydraulically actuated valve 708, utilizing the pressurized hydraulic fluid from the pressurized hydraulic fluid source of the HPU via the pressure line 718, pressurizes the close line 716 to actuate the preventer to shut in the wellbore.

In each of FIGS. 7-9, the control valve 724 of the HPU is in one of three different positions: an "open" position, a "close" position, and a "block" position. In FIG. 7, the control valve 724 is in the "open" position due to, for example, receiving an "open" command from the control panel at or near the well site. In the "open" position, the control valve 724 pressurizes the open line 720 fluidly coupled to the hydraulically actuated valve 706, by utilizing the pressurized hydraulic fluid from the pressurized hydraulic fluid source of the HPU via the pressure line 726. The control valve 724 also fluidly couples the close line 722 to the return line 728. In conventional well shut-in systems without a hydraulic diverter disclosed herein (such as the hydraulic diverter 702), the open line 720 and the close line 722 would be directly coupled to the open port and the close port of the preventer, and the control valve 724 in the "open" position would pressurize the open port of the preventer and vent the close port of the preventer to actuate the preventer to open/reopen the wellbore. However, as illustrated in FIG. 7, the open line 720 and the close line 722 are blocked by the hydraulically actuated valves 706 and 708, respectively, in the activated positions thereof. In other words, the function of the control valve 724 is isolated by the hydraulic diverter 702 from the control lines of the preventer. In effect, the hydraulic diverter 702 in the activated state renders the "open" command from the control panel irrelevant.

In FIG. 8, the control valve 724 is in the "close" position due to, for example, receiving a "close" command from the control panel at or near the well site. In the "close" position, the control valve 724 pressurizes the close line 722 fluidly coupled to the hydraulically actuated valve 708, by utilizing the pressurized hydraulic fluid from the pressurized hydraulic fluid source of the HPU via the pressure line 726. The control valve 724 also fluidly couples the open line 720 to the return line 728. In conventional well shut-in systems without a hydraulic diverter disclosed herein (such as the hydraulic diverter 702), the open line 720 and the close line 722 would be directly coupled to the open port and the close port of the preventer, and the control valve 724 in the "close" position would pressurize the close port of the preventer and vent the open port of the preventer to actuate the preventer to shut in the wellbore. However, as illustrated in FIG. 8, the open line 720 and the close line 722 are blocked by the hydraulically actuated valves 706 and 708, respectively, in the activated positions thereof. In other words, the function of the control valve 724 is isolated by the hydraulic diverter 702 from the control lines of the preventer. In effect, the hydraulic diverter 702 in the activated state renders the "close" command from the control panel irrelevant.

In FIG. 9, the control valve 724 is in the "block" position as a default setting or due to, for example, receiving a "block" command from the control panel at or near the well site. In the "block" position, the control valve 724 blocks the close line 722 fluidly coupled to the hydraulically actuated valve 708 and the open line 720 fluidly coupled to the hydraulically actuated valve 706 from the pressure line 726 and the return line 728. In conventional well shut-in systems without a hydraulic diverter disclosed herein (such as the hydraulic diverter 702), the open line 720 and the close line 722 would be directly coupled to the open port and the close port of the preventer, and the control valve 724 in the "block" position would block the close port and the open port of the preventer from the pressure line 726 and the return line 728 such that the preventer is not actuated in any way. However, as illustrated in FIG. 9, the open line 720 and the close line 722 are blocked by the hydraulically actuated valves 706 and 708, respectively, in the activated positions thereof. In other words, the function of the control valve 724 is isolated by the hydraulic diverter 702 from the control lines of the preventer. In effect, the hydraulic diverter 702 in the activated state renders the "block" command from the control panel irrelevant.

Figure 10:
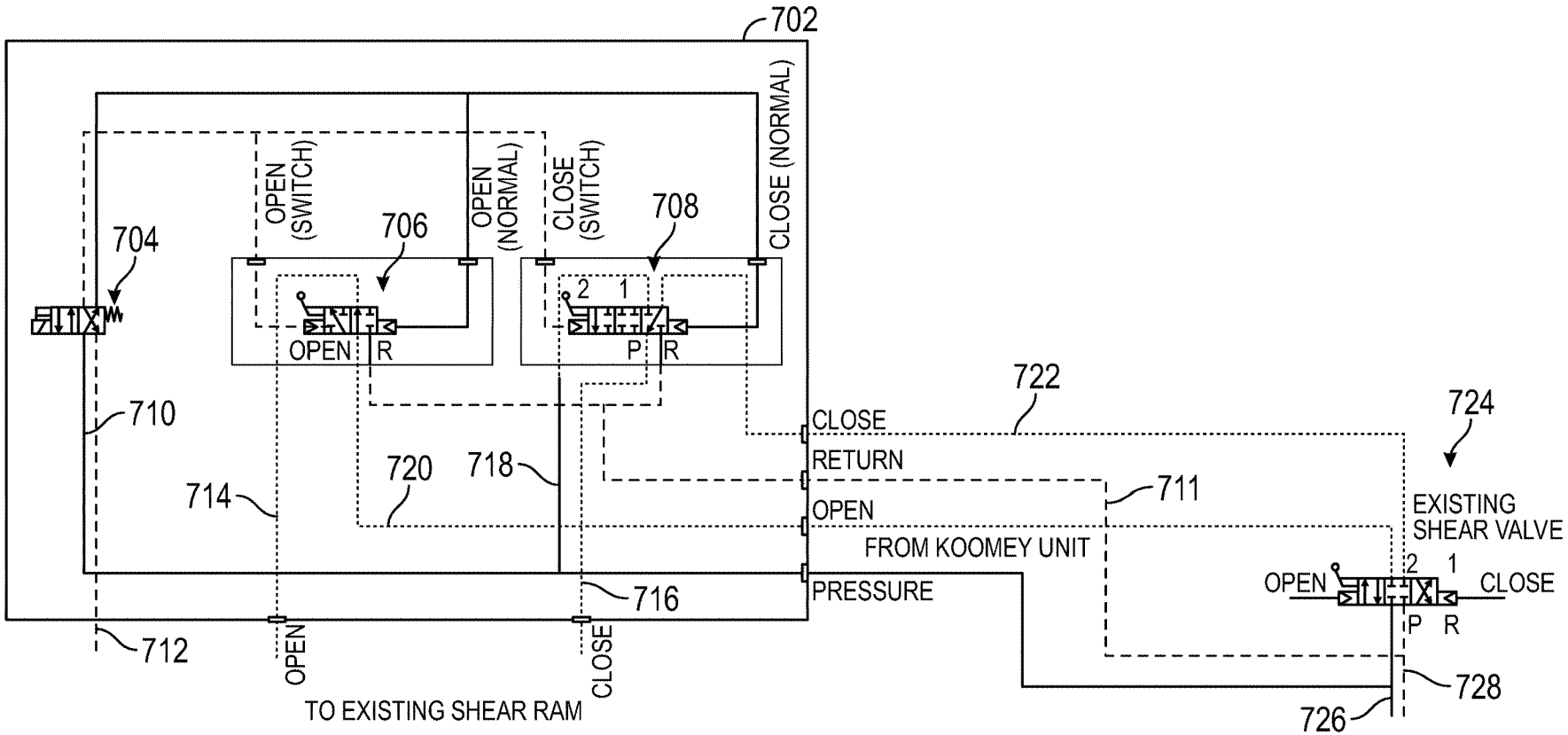
Figure 11:
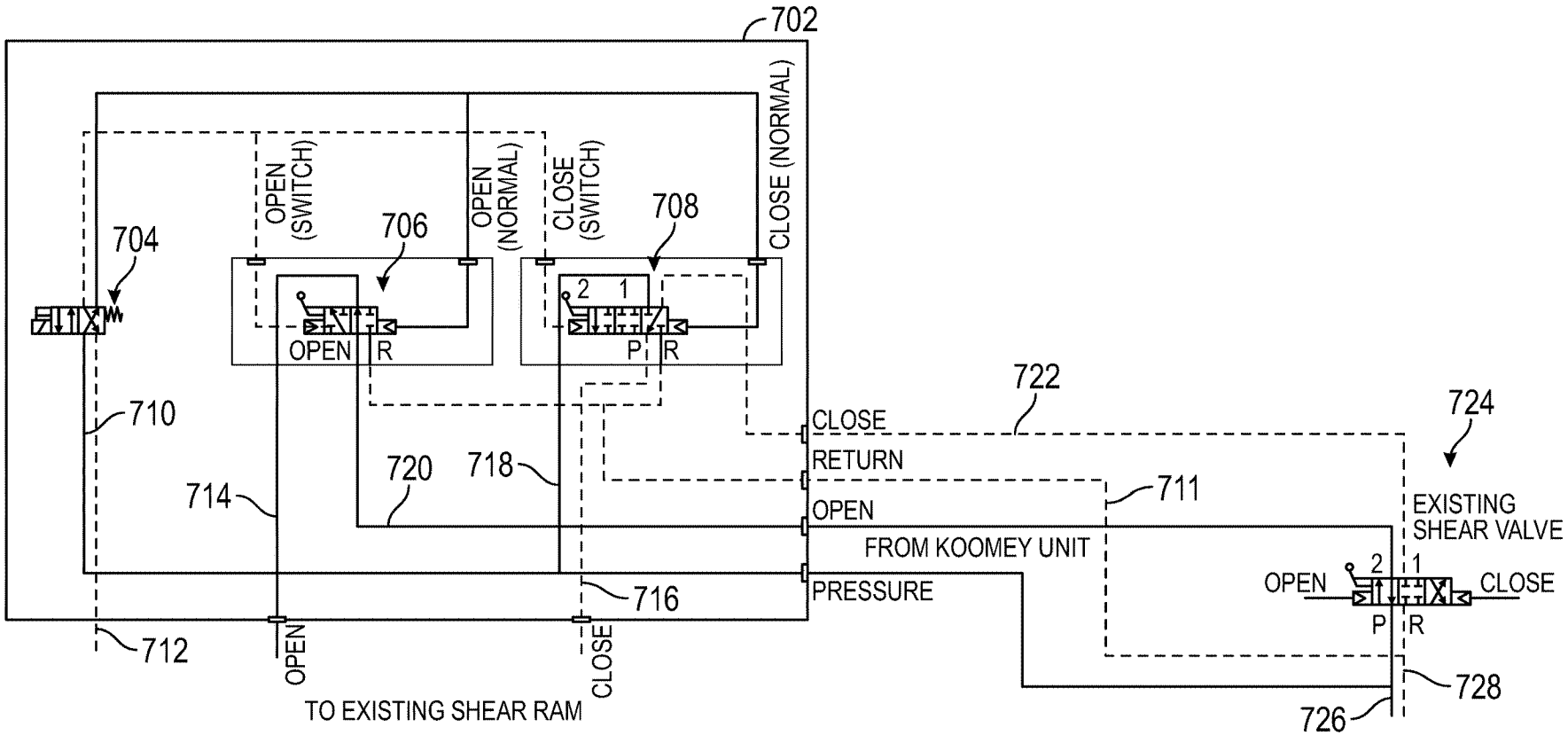
Figure 12:
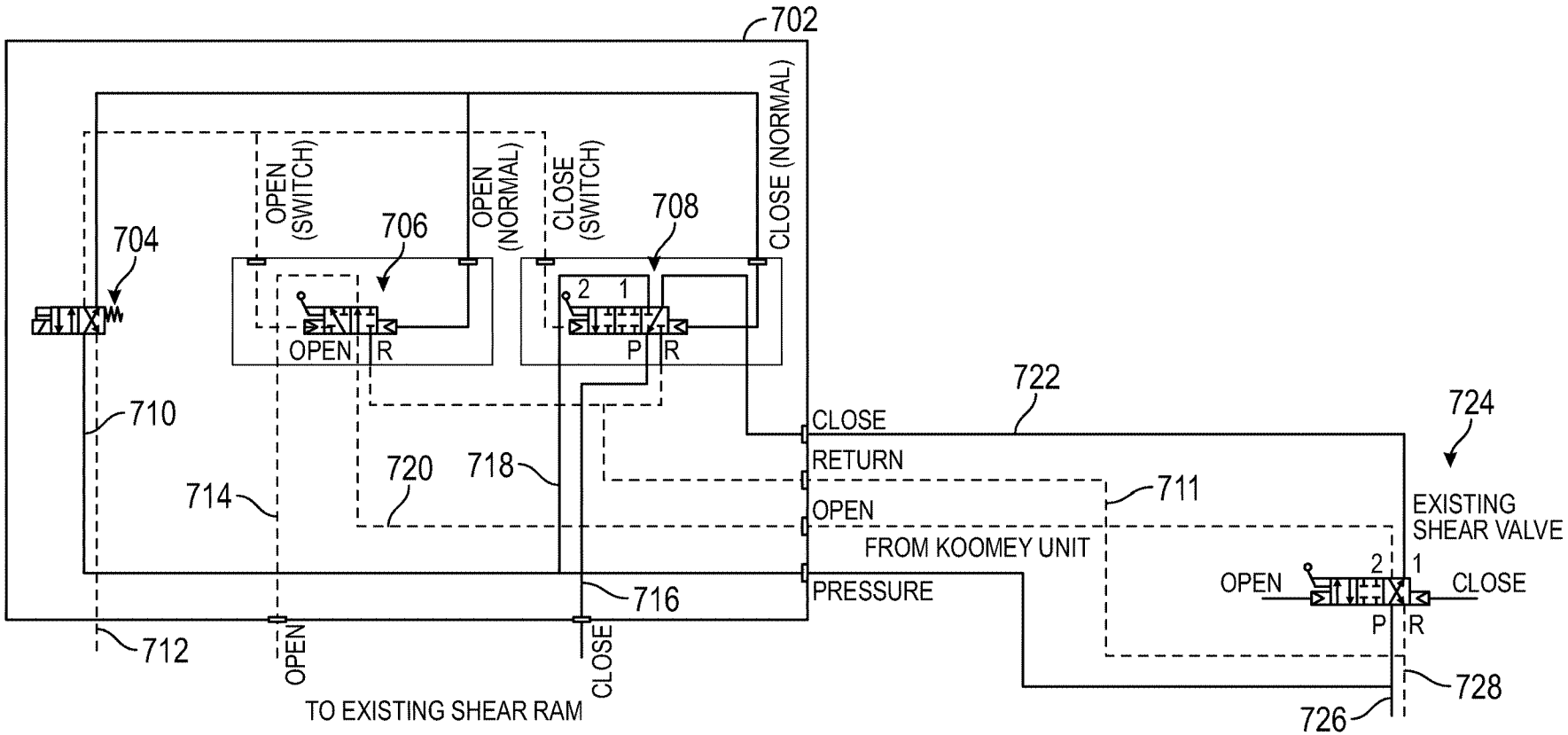

In the examples illustrated in FIGS. 10-12, the hydraulic diverter 702 is in an inactivated or standby state in the absence of a command from the local controller (or in the absence of a wireless signal sent from the remote controller to the local controller). In the standby state of the hydraulic diverter 702, the solenoid valve 704 is in the standby position thereof. The solenoid valve 704, utilizing the pressurized hydraulic fluid from the pressurized hydraulic fluid source of the HPU via the pressure line 710, pilots the two hydraulically actuated valves 706 and 708 to be in the standby positions thereof. In standby position, the hydraulically actuated valve 706 fluidly couples the open line 720 (which is fluidly coupled to the control valve 724) to the open line 714 (which is fluidly coupled to the open port of the preventer). In standby position, the hydraulically actuated valve 708 fluidly couples the close line 722 (which is fluidly coupled to the control valve 724) to the close line 716 (which is fluidly coupled to the close port of the preventer). In effect, the open line 720 and the close line 722 are fluidly coupled to the open port and the close port of the preventer, respectively, as in conventional well shut-in systems without a hydraulic diverter disclosed herein (such as the hydraulic diverter 702). In this case, the hydraulic diverter 702 yields control of the preventer to the control valve 724 of the HPU. Specifically, when the control valve 724 is in the "block" position (FIG. 10), the "open" position (FIG. 11), or the "close" position (FIG. 12), the preventer remains unactuated or blocked, is actuated to shut in the wellbore, or is actuated to open/reopen the wellbore accordingly.

FIGS. 13-18 illustrate schematic diagrams showing fluid connections of different valve states. In these Figures, fluid connections of a hydraulic diverter 802 to a HPU (not shown), a control valve 824 of the HPU, and control lines of a preventer of a BOP stack are shown. The examples illustrated in FIGS. 13-18 are similar to those illustrated in FIGS. 7-12. A major difference between the examples illustrated in FIGS. 13-18 and those illustrated in FIGS. 7-12 is the number of solenoid valves. As illustrated in FIGS. 13-18, the hydraulic diverter 802 includes two solenoid valves 803, 804 and two hydraulically actuated valves 806 and 808. The solenoid valves 803 and 804 are each fluidly coupled to the two hydraulically actuated valves 806 and 808 in order to pilot the two hydraulically actuated valves 806 and 808. For example, in the activated position of the solenoid valve 804, a port of the solenoid valve 804 may be fluidly coupled to a control port of each of the hydraulically actuated valves 806 and 808 to direct a pressurized hydraulic fluid to the control port of each of the hydraulically actuated valves 706 and 708, thereby rendering the hydraulically actuated valves 806 and 808 in their activated positions. In this case, the solenoid valve 803 is in the inactivated or standby position. Further, for example, in the activated position of the solenoid valve 803, a port of the solenoid valve 803 may be fluidly coupled to a control port of each of the hydraulically actuated valves 806 and 808 to direct a pressurized hydraulic fluid to the control port of each of the hydraulically actuated valves 806 and 808, thereby rendering the hydraulically actuated valves 806 and 808 in their standby positions. In this case, the solenoid valve 804 is in the inactivated or standby position.

As illustrated in FIGS. 13-18, the hydraulic diverter 802 is fluidly coupled to the control valve 824 of the HPU. Specifically, the hydraulically actuated valve 808 is fluidly coupled via a close line 822 to the control valve 824. The close line 822 is a hydraulic line configured to be pressurized through the control valve 824 when a "close" command from a control panel at or in a vicinity of the well site is sent to the HPU to operate the control valve 824. Further, the hydraulically actuated valve 806 is fluidly coupled via an open line 820 to the control valve 824. The open line 820 is a hydraulic line configured to be pressurized through the control valve 824 when an "open" command from the control panel is sent to the HPU to operate the control valve 824. The control valve 824 is fluidly coupled via a hydraulic line 826 to a pressurized hydraulic fluid source of the HPU (not shown) and fluidly coupled via a hydraulic line 828 to a hydraulic fluid reservoir of the HPU (not shown).

The control valve 824 may include at least two positions (states) that correspond to pressurizing the close line 822 while venting the open line 820 and pressurizing the open line 820 while venting the close line 822, respectively. The control valve 824 may be set to either of the two positions based on the "close" command or "open" command from the control panel described above. In the illustrated examples, the control valve 824 includes an additional position that blocks the open line 820 and the close line 822 from the hydraulic lines 826 and 828. The control valve 824 may be set to this position by default or based on a "block" command from the control panel.

The hydraulic diverter 802 may be fluidly coupled to the pressurized hydraulic fluid source of the HPU. In the illustrated examples, the solenoid valves 803 and 804 are fluidly coupled via a pressure line 810 to the pressurized hydraulic fluid source of the HPU. The pressure line 810 provides a pressurized hydraulic fluid that may be utilized by the solenoid valves 803 and 804 to pilot the hydraulically actuated valves 806 and 808. Further, the hydraulically actuated valve 808 is fluidly coupled via a pressure line 818 to the pressurized hydraulic fluid source of the HPU. The pressure line 818 provides a pressurized hydraulic fluid that may be utilized by the hydraulically actuated valve 808 to actuate a preventer of a BOP stack to shut in a wellbore.

The hydraulic diverter 802 may also be fluidly coupled to the hydraulic fluid reservoir of the HPU. In the illustrated examples, the hydraulically actuated valves 806 and 808 are fluidly coupled via a return line 811 to the hydraulic fluid reservoir of the HPU. Further, the solenoid valves 803 and 804 are fluidly coupled via a return line 812 to the hydraulic fluid reservoir of the HPU. Such return lines as 811 and 812 are provided for venting hydraulic fluid, for example, from a valve or a preventer, as may be readily understood by one of ordinary skill in the art.

The hydraulic diverter 802 may also be fluidly coupled to a preventer of a BOP stack. In the illustrated examples, the two hydraulically actuated valves 806 and 808 of the hydraulic diverter 802 are fluidly coupled to the preventer (not shown). In particular, the hydraulically actuated valve 808 is fluidly coupled via a close line 816 to a close port (not shown) of the preventer, and the hydraulically actuated valve 806 is fluidly coupled via an open line 814 to an open port (not shown) of the preventer. The close line 816 and the open line 814 correspond to the close supply control line 410 and the open supply control line 412 shown in FIG. 4, respectively. The close line 816 and the open line 814 together correspond to the control lines 126, 224, and 324 shown in FIGS. 1-3. Whenever the close line 816 is pressurized by a pressurized hydraulic fluid and the open line 814 is vented, the preventer fluidly coupled to the hydraulic diverter 702 is actuated to close the wellbore. Whenever the open line 814 is pressurized by the pressurized hydraulic fluid and the close line 816 is vented, the preventer fluidly coupled to the hydraulic diverter 802 is actuated to open/reopen the wellbore. As described in more detail below, which of the close line 816 and the open line 814 is pressurized or vented may be based on a command from a local controller of a remotely-activated well shut-in system as described above or based on a command from a control panel at or in a vicinity of the well site.

FIGS. 13-18 illustrate different states of the valves 803, 804, 806, 808, and 824 and the various fluid lines. In these Figures, pressurized lines are represented by solid lines, bleed or return lines are represented by dashed lines, and blocked or no-flow lines are represented by dotted lines.

In the examples illustrated in FIGS. 13-18, the hydraulic diverter 802 is in an activated state due to, for example, receiving a command from a local controller, which, in turn, is initiated by a wireless signal sent from a remote controller to the local controller. In the activated state of the hydraulic diverter 702, the solenoid valve 804 is in the activated position thereof and the solenoid valve 803 is in the standby position thereof. The solenoid valve 804, utilizing the pressurized hydraulic fluid from the pressurized hydraulic fluid source of the HPU via the pressure line 810, pilots the two hydraulically actuated valves 806 and 808 to be in the activated positions thereof. In activated position, the hydraulically actuated valve 806 vents, via the return line 811, the open line 814 that is fluidly coupled to the open port of the preventer. In activated position, the hydraulically actuated valve 808, utilizing the pressurized hydraulic fluid from the pressurized hydraulic fluid source of the HPU via the pressure line 818, pressurizes the close line 816 to actuate the preventer to shut in the wellbore.

Figure 13:
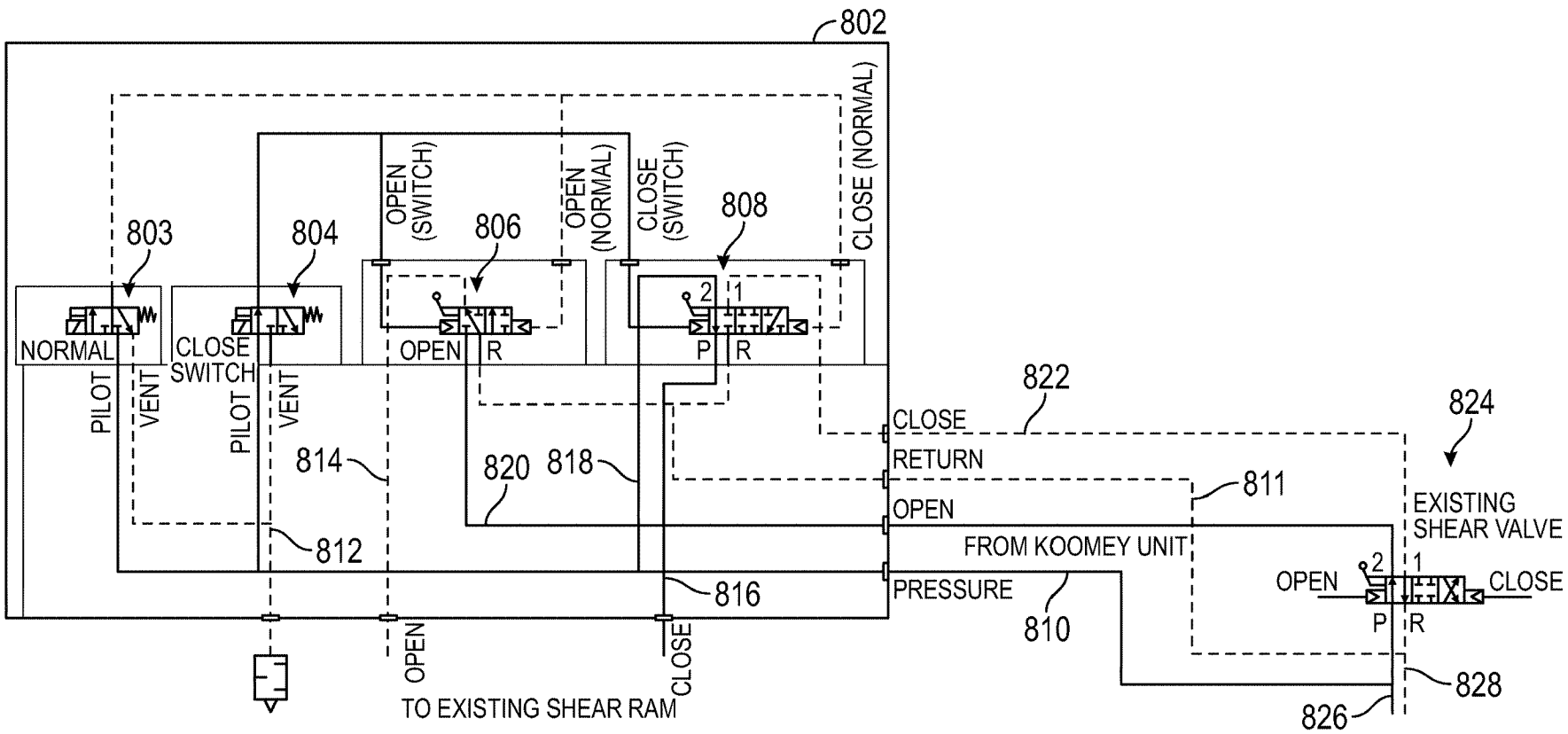
FIGS. 13-18 are schematic diagrams showing fluid connections of different valve states.
Figure 14:
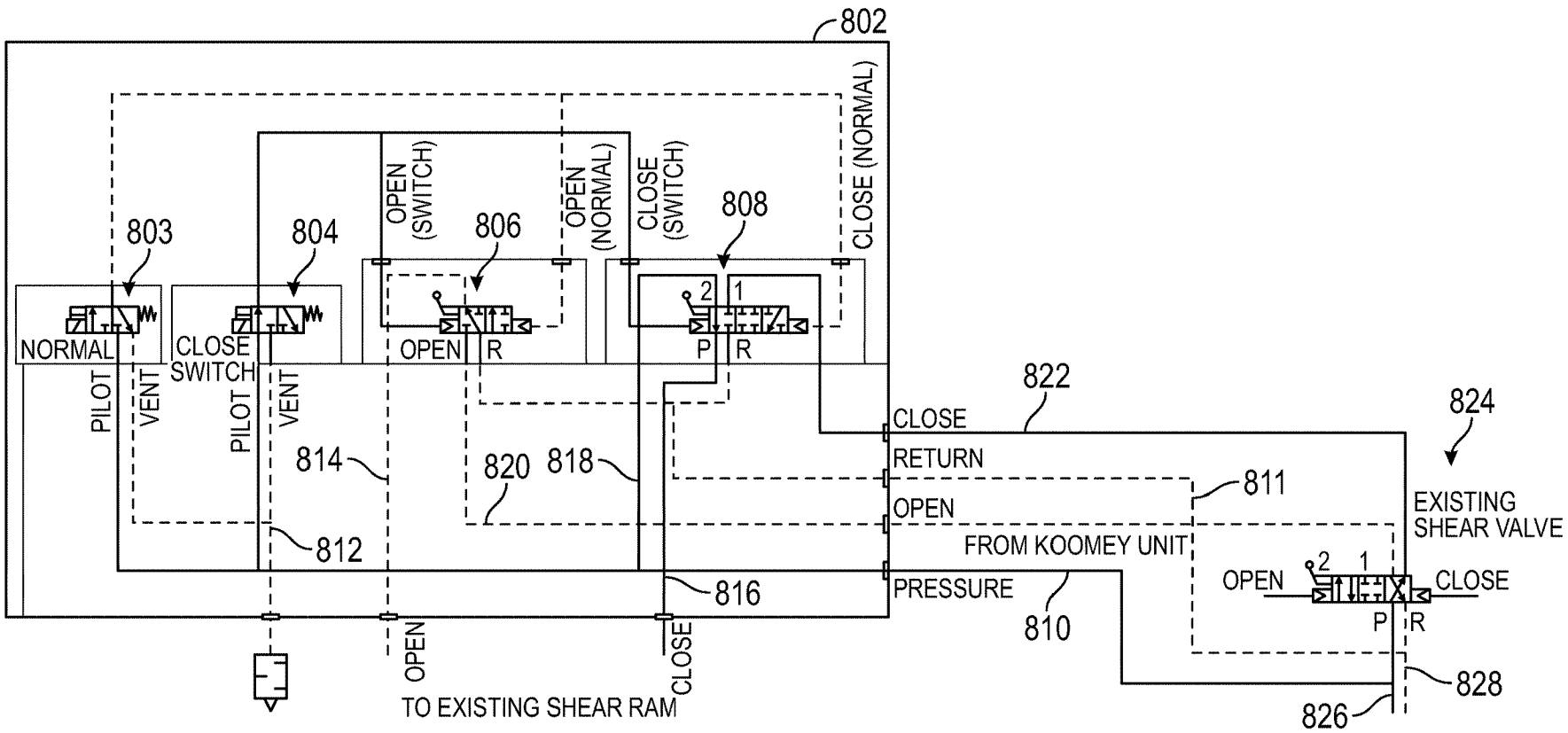
Figure 15:
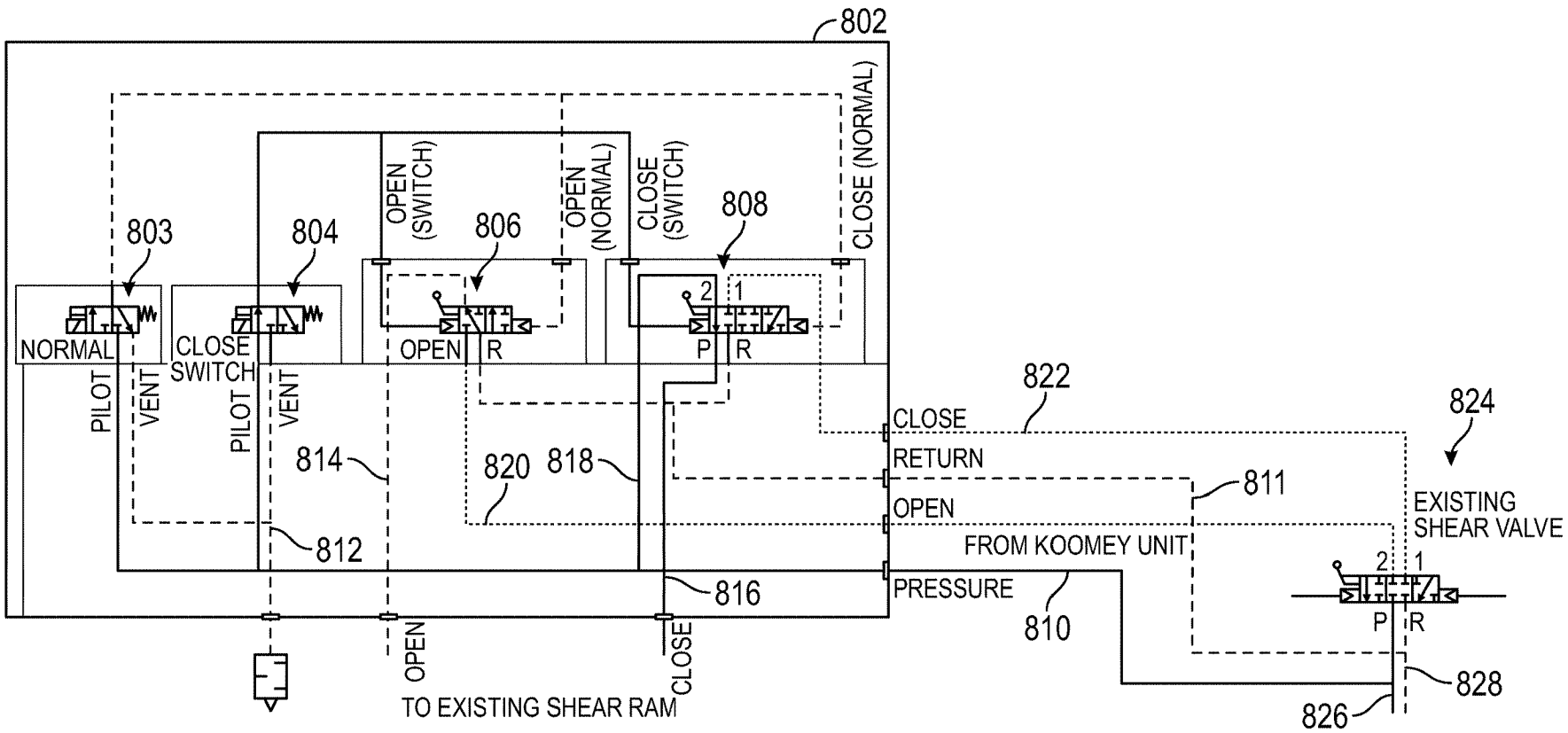

In each of FIGS. 13-15, the control valve 824 of the HPU is in one of three different positions: an "open" position, a "close" position, and a "block" position. In FIG. 13, the control valve 824 is in the "open" position due to, for example, receiving an "open" command from the control panel at or near the well site. In the "open" position, the control valve 824 pressurizes the open line 820 fluidly coupled to the hydraulically actuated valve 806, by utilizing the pressurized hydraulic fluid from the pressurized hydraulic fluid source of the HPU via the pressure line 826. The control valve 824 also fluidly couples the close line 822 to the return line 828. In conventional well shut-in systems without a hydraulic diverter disclosed herein (such as the hydraulic diverter 802), the open line 820 and the close line 822 would be directly coupled to the open port and the close port of the preventer, and the control valve 824 in the "open" position would pressurize the open port of the preventer and vent the close port of the preventer to actuate the preventer to open/reopen the wellbore. However, as illustrated in FIG.

13, the open line 820 and the close line 822 are blocked by the hydraulically actuated valves 806 and 808, respectively, in the activated positions thereof. In other words, the function of the control valve 824 is isolated by the hydraulic diverter 802 from the control lines of the preventer. In effect, the hydraulic diverter 802 in the activated state renders the "open" command from the control panel irrelevant.

In FIG. 14, the control valve 824 is in the "close" position due to, for example, receiving a "close" command from the control panel at or near the well site. In the "close" position, the control valve 824 pressurizes the close line 822 fluidly coupled to the hydraulically actuated valve 808, by utilizing the pressurized hydraulic fluid from the pressurized hydraulic fluid source of the HPU via the pressure line 826. The control valve 824 also fluidly couples the open line 820 to the return line 828. In conventional well shut-in systems without a hydraulic diverter disclosed herein (such as the hydraulic diverter 802), the open line 820 and the close line 822 would be directly coupled to the open port and the close port of the preventer, and the control valve 824 in the "close" position would pressurize the close port of the preventer and vent the open port of the preventer to actuate the preventer to shut in the wellbore. However, as illustrated in FIG. 14, the open line 820 and the close line 822 are blocked by the hydraulically actuated valves 806 and 808, respectively, in the activated positions thereof. In other words, the function of the control valve 824 is isolated by the hydraulic diverter 802 from the control lines of the preventer. In effect, the hydraulic diverter 802 in the activated state renders the "close" command from the control panel irrelevant.

In FIG. 15, the control valve 824 is in the "block" position as a default setting or due to, for example, receiving a "block" command from the control panel at or near the well site. In the "block" position, the control valve 824 blocks the close line 822 fluidly coupled to the hydraulically actuated valve 808 and the open line 820 fluidly coupled to the hydraulically actuated valve 806 from the pressure line 826 and the return line 828. In conventional well shut-in systems without a hydraulic diverter disclosed herein (such as the hydraulic diverter 802), the open line 820 and the close line 822 would be directly coupled to the open port and the close port of the preventer, and the control valve 824 in the "block" position would block the close port and the open port of the preventer from the pressure line 826 and the return line 828 such that the preventer is not actuated in any way. However, as illustrated in FIG. 15, the open line 820 and the close line 822 are blocked by the hydraulically actuated valves 806 and 808, respectively, in the activated positions thereof. In other words, the function of the control valve 824 is isolated by the hydraulic diverter 802 from the control lines of the preventer. In effect, the hydraulic diverter 802 in the activated state renders the "block" command from the control panel irrelevant.

Figure 16:
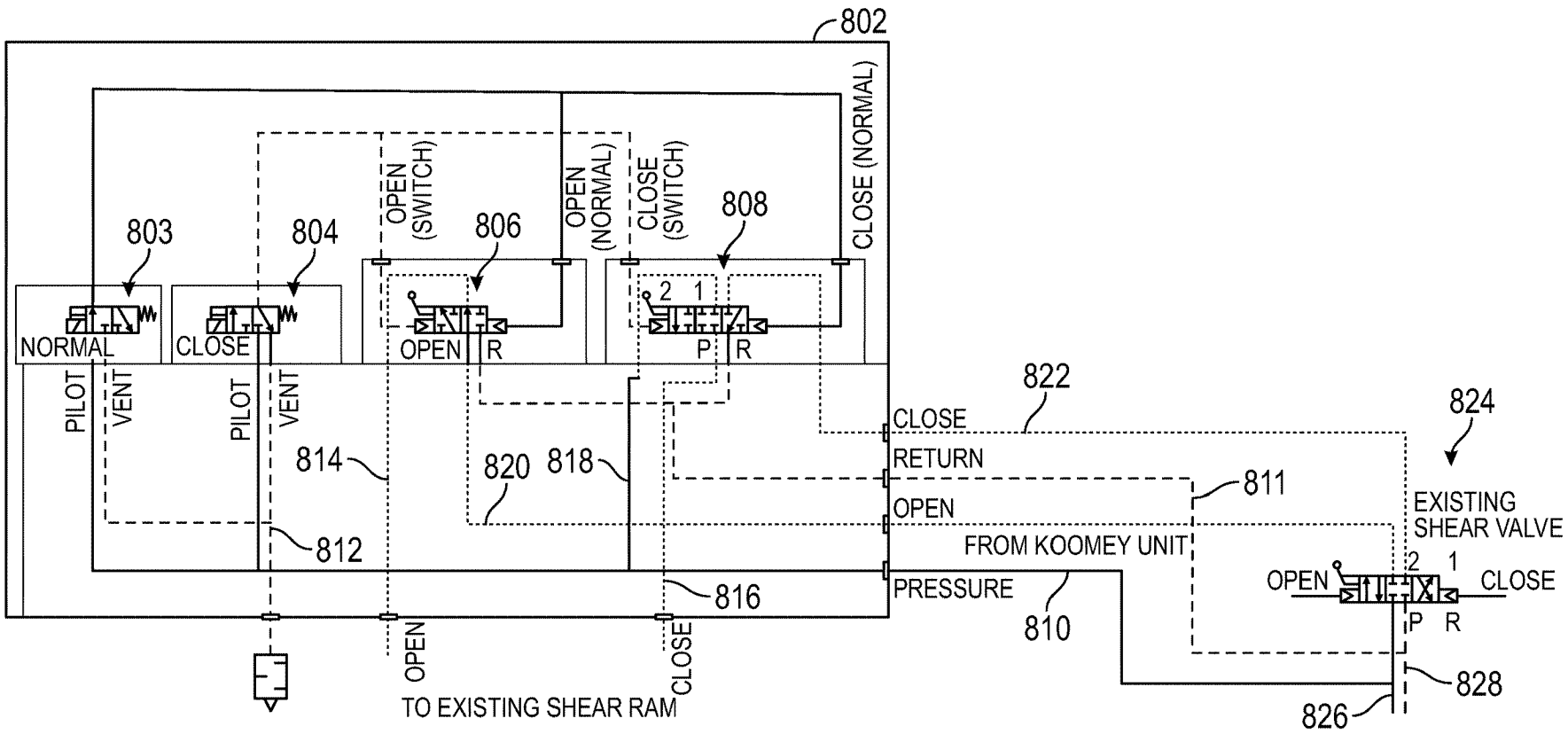
Figure 17:
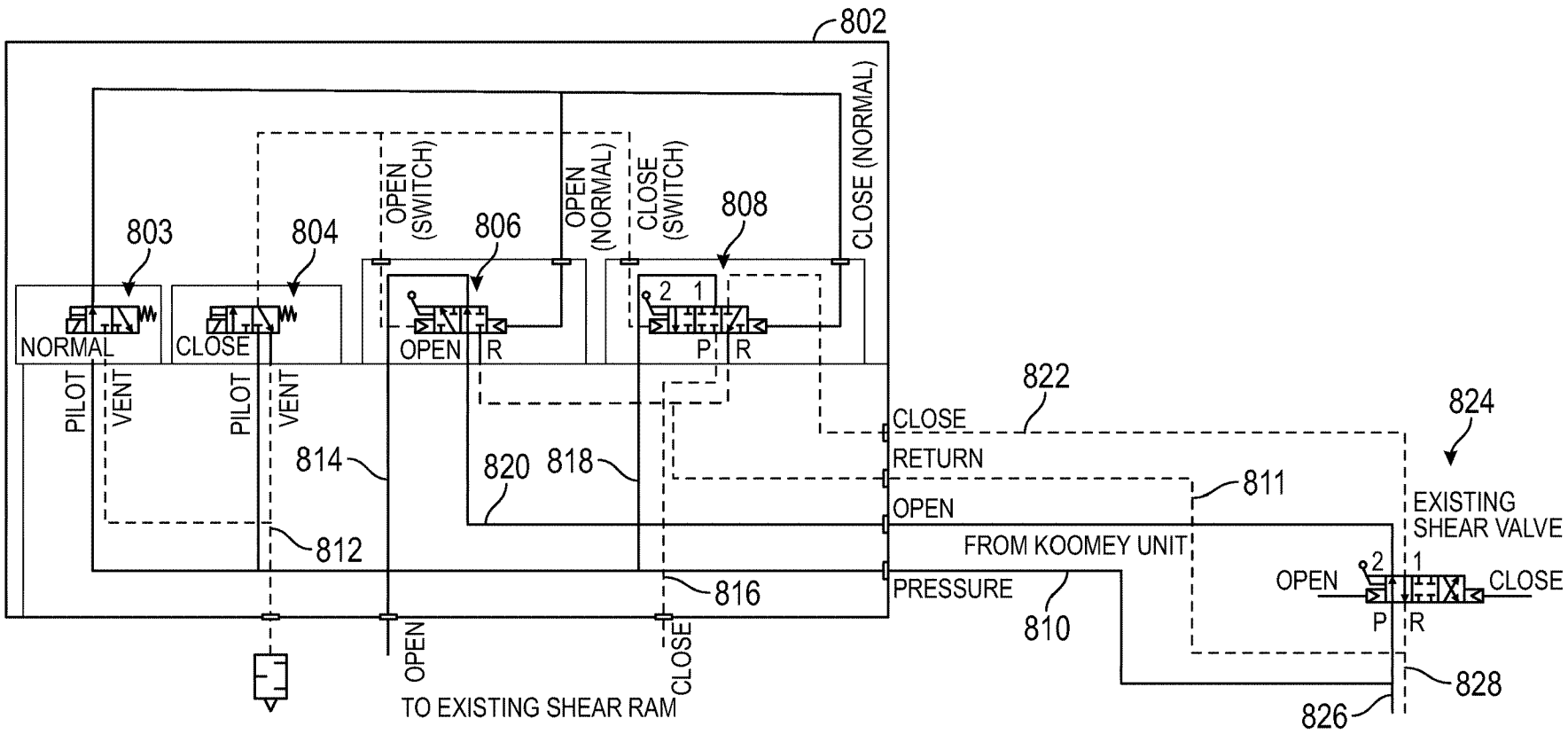
Figure 18:
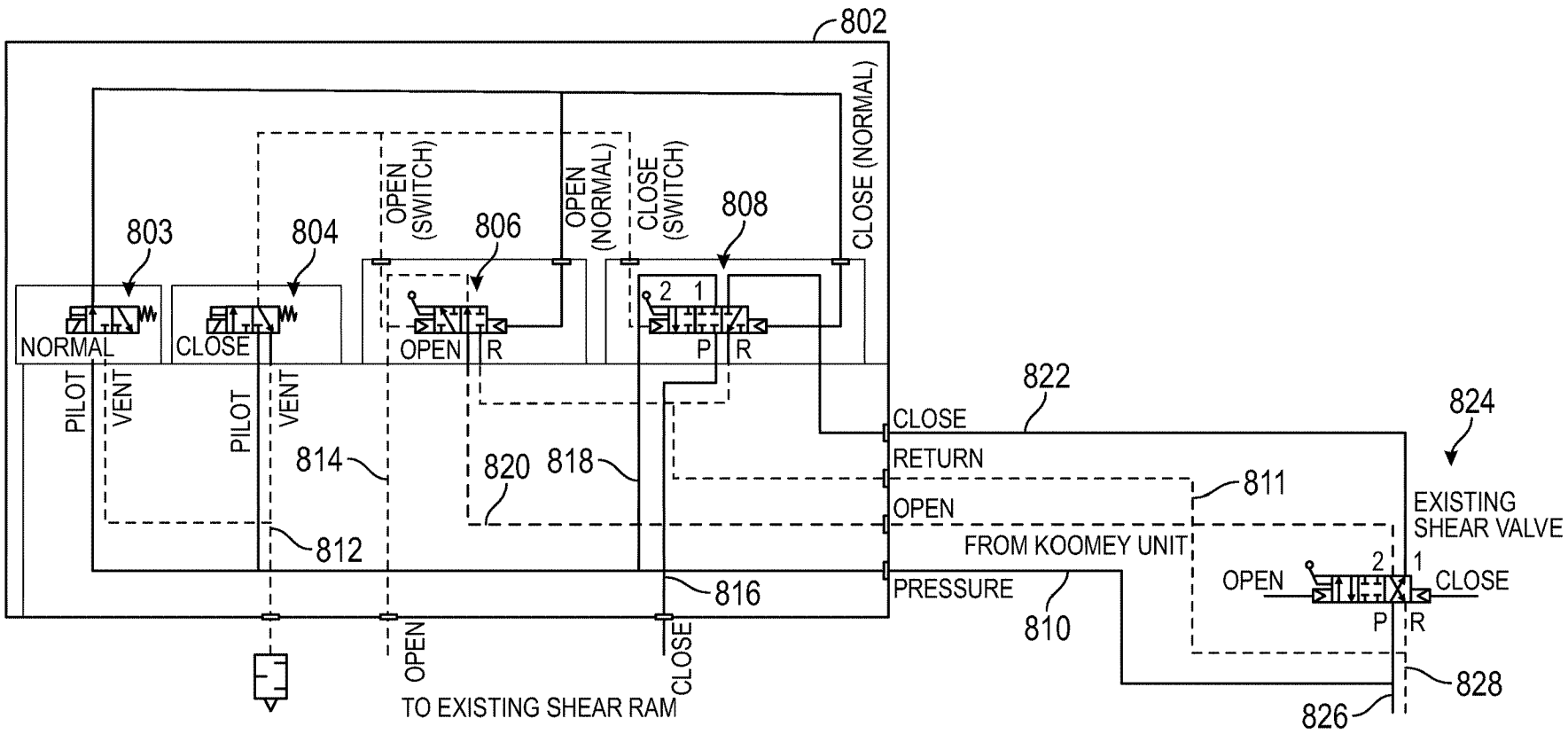

In the examples illustrated in FIGS. 16-18, the hydraulic diverter 802 is in an inactivated or standby state in the absence of a command from the local controller (or in the absence of a wireless signal sent from the remote controller to the local controller). In the standby state of the hydraulic diverter 802, the solenoid valve 804 is in the standby position thereof and the solenoid valve 803 is in the activated position thereof. The solenoid valve 803 in the activated position may a normal state of the solenoid valve 803. The solenoid valve 803, utilizing the pressurized hydraulic fluid from the pressurized hydraulic fluid source of the HPU via the pressure line 810, pilots the two hydraulically actuated valves 806 and 808 to be in the standby positions thereof. In standby position, the hydraulically actuated valve 806 fluidly couples the open line 820 (which is fluidly coupled to the control valve 824) to the open line 814 (which is fluidly coupled to the open port of the preventer). In standby position, the hydraulically actuated valve 808 fluidly couples the close line 822 (which is fluidly coupled to the control valve 824) to the close line 816 (which is fluidly coupled to the close port of the preventer). In effect, the open line 820 and the close line 822 are fluidly coupled to the open port and the close port of the preventer, respectively, as in conventional well shut-in systems without a hydraulic diverter disclosed herein (such as the hydraulic diverter 802). In this case, the hydraulic diverter 802 yields control of the preventer to the control valve 824 of the HPU. Specifically, when the control valve 824 is in the "block" position (FIG. 16), the "open" position (FIG. 17), or the "close" position (FIG. 18), the preventer remains unactuated or blocked, is actuated to shut in the wellbore, or is actuated to open/reopen the wellbore accordingly.

Although FIGS. 7-18 show each of the valves 704, 706, 708, 724, 803, 804, 806, 808, and 824 with a specific number of ports and a specific number of positions (states), each of these valves may include any suitable number of ports and any suitable number of positions (states). In addition, each of these valves may further include manual control (such as push button and lever) or mechanical control (such as spring and roller). For example, while the solenoid valve 704 is shown as a pilot valve that has four ports and two positions (a 4/2 valve), the solenoid valve 704 may be, for example, a 4/3 valve. The additional position, for example, may be a block position (state).

Figure 19:
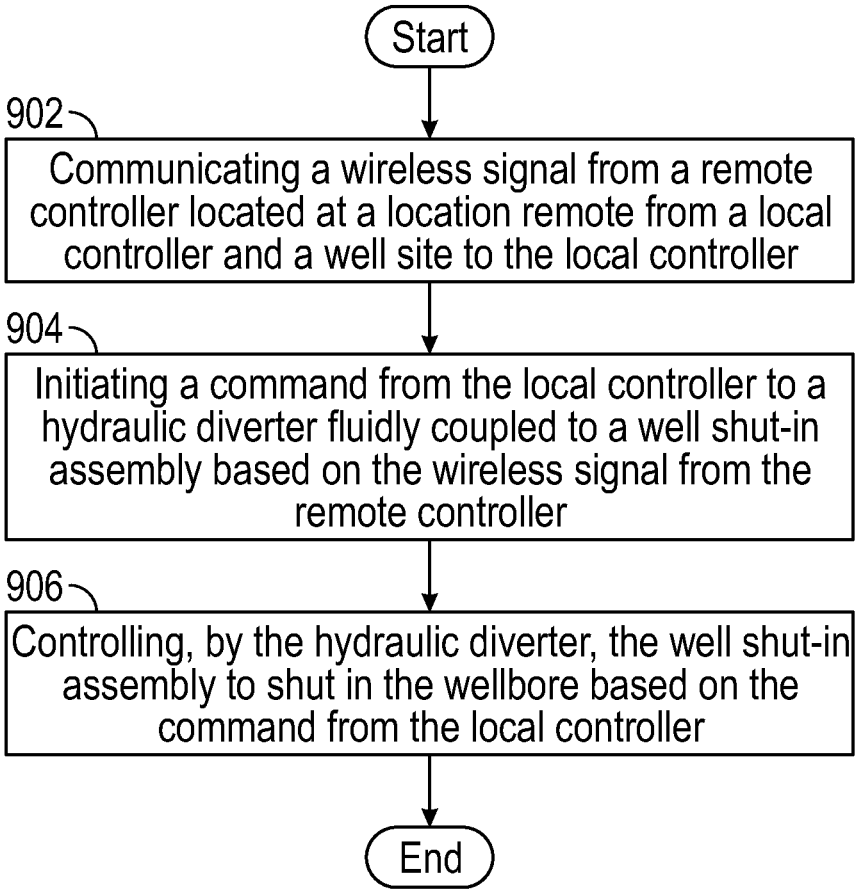
FIG. 19 is a flowchart of an example method.

FIG. 19 illustrates a flowchart of an example method for shutting in a wellbore. In Step 902, a wireless signal is communicated from a remote controller located at a location remote from a local controller and a well site to the local controller. In Step 904, a command is initiated from the local controller to a hydraulic diverter fluidly coupled to a well shut-in assembly based on the wireless signal from the remote controller. In Step 906, the well shut-in assembly is controlled, by the hydraulic diverter, to shut in the wellbore based on the command from the local controller.

In some embodiments, the well shut-in assembly may be operable to shut in or open the wellbore based on a command from a control panel at or in a vicinity of the well site. In these embodiments, the method may further include rendering, by the hydraulic diverter, the command from the control panel irrelevant based on the command from the local controller.

In some embodiments, the hydraulic diverter may include at least one solenoid valve and two hydraulically actuated valves fluidly coupled to the well shut-in assembly. In these embodiments, controlling the well shut-in assembly to shut in the wellbore based on the command from the local controller may include piloting, by the at least one solenoid valve, the two hydraulically actuated valves to activate the well shut-in assembly to shut in the wellbore.

In some embodiments, the well shut-in assembly may include a BOP stack including a preventer configured to shut in the wellbore and an HPU fluidly coupled to the preventer of the BOP stack via the hydraulic diverter. In these embodiments, controlling the well shut-in assembly to shut in the wellbore based on the command from the local controller may further include drawing, by one of the two hydraulically actuated valves based on the piloting of the at least one solenoid valve, on a pressure line of the HPU to activate the preventer of the BOP stack.

In an example operation according to the present disclosure, during a rig evacuation, one or more designated persons (for example, a rig supervisor and tool pusher) may each possess a remote controller for a remotely-activated well shut-in system. Additional remote controllers may be assigned to other rig personnel or placed at designated locations on or off the rig site. Examples of such locations include but are not limited to an onshore rig camp location or a muster station in an offshore installation. Remote controllers may be operable to wirelessly communicate with a local controller of the remotely-activated well shut-in system. In turn, the local controller may be communicably coupled to a hydraulic diverter fluidly coupled to an HPU and at least one preventer of a BOP stack of the rig.

Upon confirmation or initiation of an emergency event or potential for an emergency event (for example, well blow out) and after retreating to a safe range, for example, predetermined by the expected well conditions and company policies (for example, up to several miles from rig site), the remote controller may be activated to initiate well shut-in. For example, the remote controller signals to the local controller to activate the hydraulic diverter, which in turn actuates the preventer (for example, a shear, blind, pipe, or annular preventer). The well may thus be shut in or the well control incident may at least be reduced in severity. In some instances, confirmation of preventer actuation may be sent from the local controller to the remote controller, along with, in some examples, well and well control data (for example, pressures, temperatures, well control equipment status, etc.).

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112(f) for any limitations of any of the claims herein, except for those in which the claim expressly uses the words 'means for' together with an associated function.

What is claimed is:

1. A well system comprising:

a local controller communicably coupled to a hydraulic diverter configured to control a well shut-in assembly at a well site, the well shut-in assembly operable to shut in a wellbore based on a command from the local controller or to shut in or open the wellbore based on a command from a control panel at or in a vicinity of the well site;

a remote controller located at a location remote from the local controller and the well site and configured to communicate a wireless signal to the local controller to initiate the command from the local controller; and the hydraulic diverter fluidly coupled to the well shut-in assembly, wherein the hydraulic diverter is configured to, based on the command from the local controller, control the well shut-in assembly to shut in the wellbore and render the command from the control panel irrelevant.

2. The well system of claim 1, wherein in the absence of the command from the local controller, the hydraulic diverter is configured to, based on the command from the control panel, control the well shut-in assembly to shut in or open the wellbore.

3. The well system of claim 1, wherein the hydraulic diverter comprises:

at least one solenoid valve; and two hydraulically actuated valves piloted by the at least one solenoid valve, wherein the command from the local controller is operable to adjust the at least one solenoid valve.

4. The well system of claim 3, wherein the well shut-in assembly comprises:

a blowout preventer (BOP) stack comprising a preventer configured to shut in the wellbore; and a hydraulic power unit (HPU) fluidly coupled to the preventer of the BOP stack via the hydraulic diverter.

5. The well system of claim 4, wherein the HPU comprises at least one control valve communicably coupled to the control panel, and wherein the command from the control panel is operable to adjust the at least one control valve of the HPU.

6. The well system of claim 5, wherein the two hydraulically actuated valves are fluidly coupled to the preventer of the BOP stack and the at least one control valve of the HPU.

7. The well system of claim 4, wherein one of the two hydraulically actuated valves is fluidly coupled to a pressure line of the HPU.

8. The well system of claim 4, wherein the at least one solenoid valve is fluidly coupled to a pressure line of the HPU.

9. The well system of claim 3, wherein the at least one solenoid valve comprises two solenoid valves.

10. The well system of claim 9, wherein the two hydraulically actuated valves are piloted by each of the two solenoid valves.

11. A hydraulic diverter fluidly coupled to a well shut-in assembly in a well system at a well site that comprises a blowout preventer (BOP) stack and a hydraulic power unit (HPU), the hydraulic diverter comprising:

at least one solenoid valve; and two hydraulically actuated valves piloted by the at least one solenoid valve, wherein a preventer of the BOP stack is configured to be fluidly coupled to the HPU via the hydraulic diverter, wherein the well shut-in assembly is operable to shut in or open a wellbore based on a command from a local controller communicably coupled to the hydraulic diverter or to shut in or open the wellbore based on a command from a control panel at or in a vicinity of the wellsite, wherein the well system comprises a remote controller located at a location remote from the local controller and the well site and configured to communicate a wireless signal to the local controller to initiate the command from the local controller, wherein the hydraulic diverter is configured to, based on the command from the local controller, control the well shut-in assembly to shut in the wellbore and render the command from the control panel irrelevant.

12. The hydraulic diverter of claim 11, wherein the two hydraulically actuated valves are configured to be fluidly coupled to the preventer of the BOP stack and at least one control valve of the HPU.

13. The hydraulic diverter of claim 11, wherein one of the two hydraulically actuated valves is configured to be fluidly coupled to a pressure line of the HPU.

14. The hydraulic diverter of claim 11, wherein the at least one solenoid valve is configured to be fluidly coupled to a pressure line of the HPU.

15. The hydraulic diverter of claim 11, wherein the at least one solenoid valve comprises two solenoid valves.

16. The hydraulic diverter of claim 15, wherein the two hydraulically actuated valves are piloted by each of the two solenoid valves.

17. A method for shutting a wellbore comprising:

communicating a wireless signal from a remote controller located at a location remote from a local controller and a well site to the local controller;

initiating a command from the local controller to a hydraulic diverter fluidly coupled to a well shut-in assembly based on the wireless signal from the remote controller;

initiating a command from a control panel at or in a vicinity of the well site to the hydraulic diverter;

controlling, by the hydraulic diverter, the well shut-in assembly to shut in the wellbore based on the command from the local controller or the command from the control panel; and rendering the command from the control panel irrelevant, via the hydraulic diverter, based on the command from the local controller.

18. The method of claim 17, wherein the well shut-in assembly is operable to shut in or open the wellbore based on a command from the control panel at or in a vicinity of the well site.

19. The method of claim 17, wherein the hydraulic diverter comprises at least one solenoid valve and two hydraulically actuated valves fluidly coupled to the well shut-in assembly, and wherein controlling the well shut-in assembly to shut in the wellbore based on the command from the local controller comprises:

piloting, by the at least one solenoid valve, the two hydraulically actuated valves to activate the well shut-in assembly to shut in the wellbore.

20. The method of claim 19, wherein the well shut-in assembly comprises:

a blowout preventer (BOP) stack comprising a preventer configured to shut in the wellbore; and a hydraulic power unit (HPU) fluidly coupled to the preventer of the BOP stack via the hydraulic diverter, and wherein controlling the well shut-in assembly to shut in the wellbore based on the command from the local controller further comprises:

drawing, by one of the two hydraulically actuated valves based on the piloting of the at least one solenoid valve, on a pressure line of the HPU to activate the preventer of the BOP stack.

* * * * *